US011020979B2

(12) United States Patent
Horade

(10) Patent No.: US 11,020,979 B2
(45) Date of Patent: Jun. 1, 2021

(54) LIQUID DISCHARGE DEVICE

(71) Applicant: BROTHER KOGYO KABUSHIKI KAISHA, Nagoya (JP)

(72) Inventor: Kenta Horade, Tokai (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 69 days.

(21) Appl. No.: 16/583,962

(22) Filed: Sep. 26, 2019

(65) Prior Publication Data

US 2020/0101752 A1 Apr. 2, 2020

(30) Foreign Application Priority Data

Sep. 28, 2018 (JP) ..... JP2018-185954

(51) Int. Cl.
*B41J 2/175* (2006.01)

(52) U.S. Cl.
CPC ..... *B41J 2/17566* (2013.01); *B41J 2/17503* (2013.01)

(58) Field of Classification Search
CPC ..... B41J 2/17566; B41J 2/17503; B41J 2002/17573; B41J 2002/17579; B41J 29/38; B41J 2/17513; B41J 2/17546; B41J 29/13; B41J 2/1752; B41J 2/17523; B41J 2/17509
See application file for complete search history.

(56) References Cited

U.S. PATENT DOCUMENTS 8,029,115 B2 * 10/2011 Usui ..... B41J 2/17553 347/86
2008/0204488 A1 8/2008 Usui
2019/0105909 A1 * 4/2019 Horade ..... B41J 2/1752
2019/0105910 A1 * 4/2019 Ueda ..... B41J 2/17553
2019/0105913 A1 * 4/2019 Horade ..... B41J 2/17513
2019/0105914 A1 * 4/2019 Horade ..... B41J 2/17566
2020/0101749 A1 * 4/2020 Horade ..... B41J 2/17546

FOREIGN PATENT DOCUMENTS

JP 2008-213162 A 9/2008

* cited by examiner

*Primary Examiner* — Huan H Tran
(74) *Attorney, Agent, or Firm* — Merchant & Gould P.C.

(57) ABSTRACT

One aspect of the present disclosure is directed to a liquid discharge device that determines the amount of liquid stored in each of a first liquid chamber of cartridge and a second liquid chamber of the tank. Another aspect of the present disclosure is directed to a liquid discharge device that deactivates an alarm or enables previously disabled printing after the cartridge is replaced and then the liquid is reliably determined to have flown into the second liquid chamber of the tank.

20 Claims, 21 Drawing Sheets

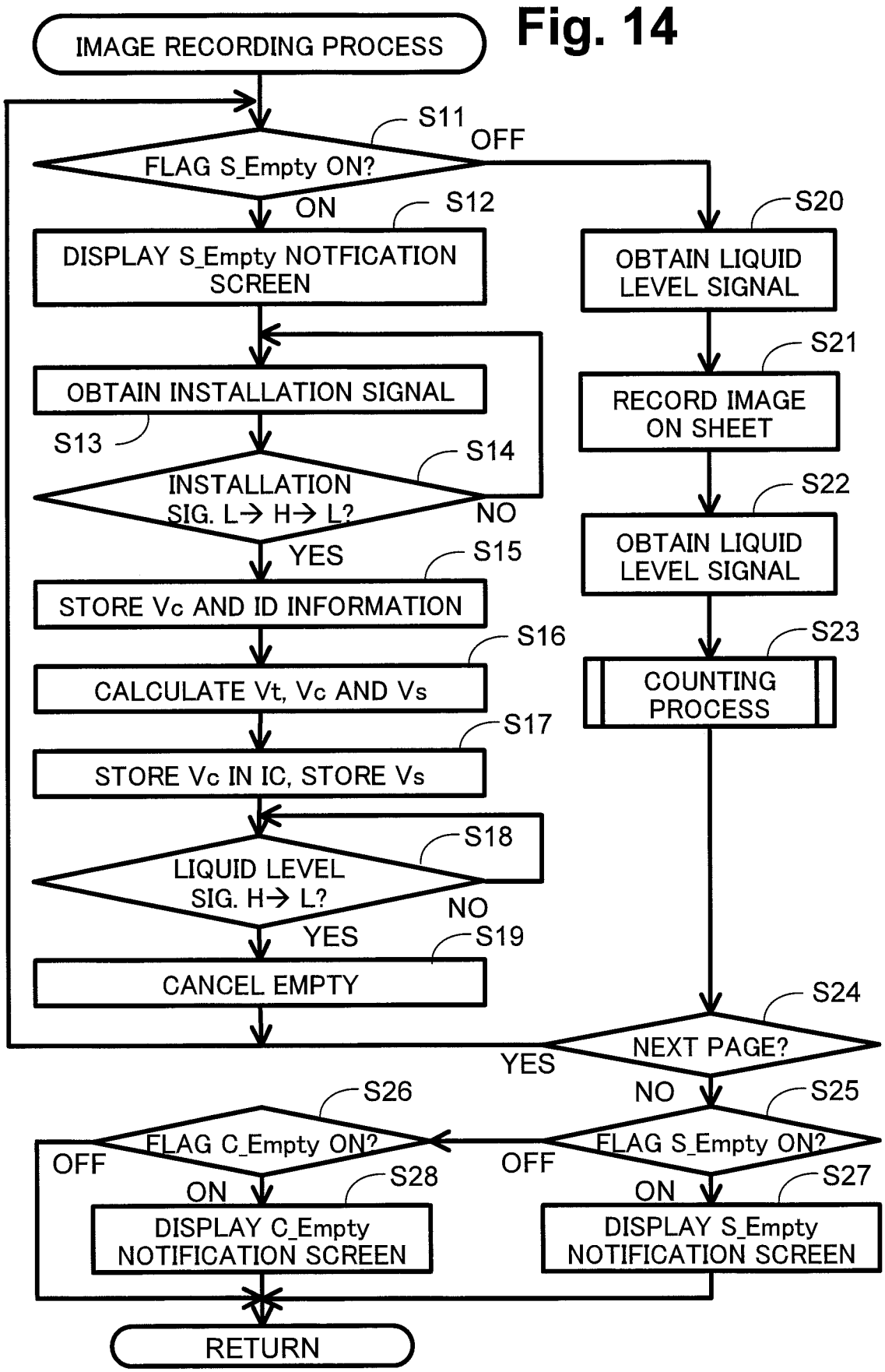
Fig. 14
IMAGE RECORDING PROCESS
S11
FLAG S_Empty ON?
OFF
ON
S12
DISPLAY S_Empty NOTFICATION SCREEN
OBTAIN INSTALLATION SIGNAL
S13
S14
INSTALLATION SIG. L→ H→ L?
NO
YES
S15
STORE Vc AND ID INFORMATION
S16
CALCULATE Vt, Vc AND Vs
S17
STORE Vc IN IC, STORE Vs
S18
LIQUID LEVEL SIG. H→ L?
NO
YES
S19
CANCEL EMPTY
S20
OBTAIN LIQUID LEVEL SIGNAL
S21
RECORD IMAGE ON SHEET
S22
OBTAIN LIQUID LEVEL SIGNAL
S23
COUNTING PROCESS
S24
NEXT PAGE?
YES
NO
S25
FLAG S_Empty ON?
OFF
ON
S27
DISPLAY S_Empty NOTIFICATION SCREEN
S26
FLAG C_Empty ON?
OFF
ON
S28
DISPLAY C_Empty NOTIFICATION SCREEN
RETURN

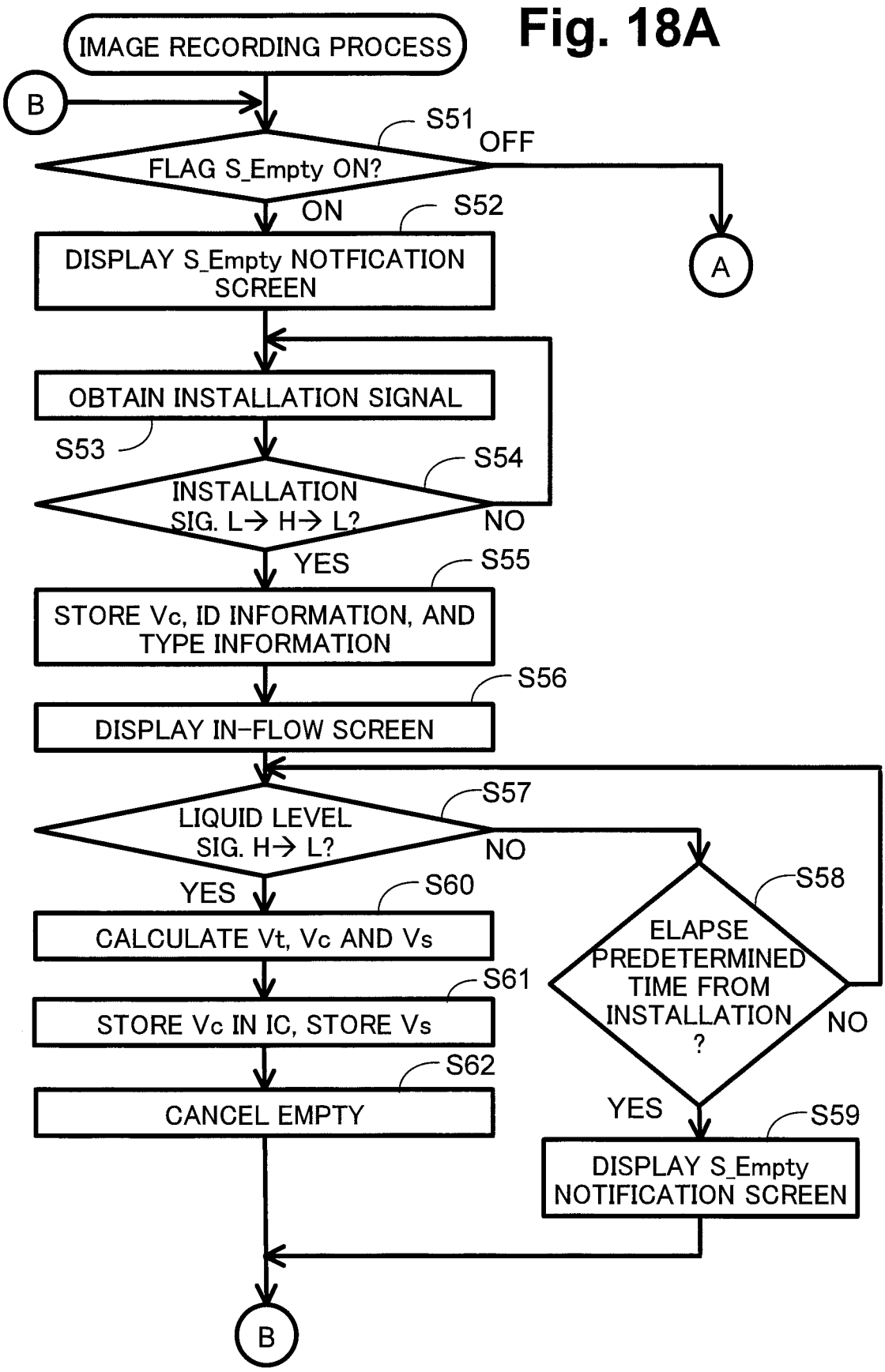
Fig. 18A
IMAGE RECORDING PROCESS
B
S51
FLAG S_Empty ON?
OFF
ON
S52
DISPLAY S_Empty NOTFICATION SCREEN
A
OBTAIN INSTALLATION SIGNAL
S53
S54
INSTALLATION SIG. L→ H→ L?
NO
YES
S55
STORE Vc, ID INFORMATION, AND TYPE INFORMATION
S56
DISPLAY IN-FLOW SCREEN
S57
LIQUID LEVEL SIG. H→ L?
NO
YES
S60
CALCULATE Vt, Vc AND Vs
S61
STORE Vc IN IC, STORE Vs
S62
CANCEL EMPTY
S58
ELAPSE PREDETERMINED TIME FROM INSTALLATION ?
NO
YES
S59
DISPLAY S_Empty NOTIFICATION SCREEN
B

LIQUID DISCHARGE DEVICE

CROSS-REFERENCE TO RELATED APPLICATION

This application claims priority from Japanese Patent Application No. 2018-185954 filed on Sep. 28, 2018, the content of which is incorporated herein by reference in its entirety.

TECHNICAL FIELD

The present disclosure relates to a liquid discharge device for discharging liquid.

BACKGROUND

A known inkjet printer includes a removable main tank, a subtank storing ink fed from the main tank that has been installed, and an image recording unit that discharges ink from the subtank to print an image (e.g., JP-A-2008-213162). The main tank and the subtank each have the internal space open to the air. When the main tank is installed in the inkjet printer, the liquid height difference between the internal spaces of the main tank and the subtank (hereinafter, the water head difference) causes ink transfer between the tanks toward the same liquid level. The inkjet printer then displays, on a display, a message urging replacement of the main tank, or disables the ink discharge through the image recording unit when the residual amount of the ink detected by a residual amount sensor decreases below a threshold.

SUMMARY

As the image recording unit discharges ink, the amount of liquid stored in each of the main tank and the subtank changes. For example, when the amount of ink stored in the cartridge decreases to near zero, the user may be urged to replace the cartridge. When the amount of ink stored in the subtank decreases to near zero, the user may be notified or the image recording may be disabled to prevent entry of air from the subtank into the image recording unit. The ink amounts of the main tank and the subtank are thus to be determined.

After the main tank is replaced, ink flows from the main tank into the subtank, thus increasing the residual ink amount in the subtank. In response to the main tank replacement, the message indicating the empty cartridge may be deleted from the display or the disabled ink discharge may be enabled. However, the determination as to whether the ink is flowing into the subtank cannot be performed until the signal output from the residual amount sensor changes. When, for example, the newly installed main tank stores a small amount of ink, the ink flow from the main tank into the subtank stops after the small amount of ink flows into the subtank. When the message indicating the empty cartridge is deleted in response to the main tank replacement, the empty state can actually continue although the message has been deleted. When the disabled ink discharge is enabled in response to the main tank replacement, the image recording may cause air entrapment or specifically the entry of air into an ink flow path from the subtank to the image recording unit.

In response to the above issue, one aspect of the present disclosure is directed to a liquid discharge device that determines the amount of liquid stored in each of a first liquid chamber and a second liquid chamber.

Another aspect of the present disclosure is directed to a liquid discharge device that deactivates an alarm or enables previously disabled printing after the cartridge is replaced and then the liquid is reliably determined to have flown into the second liquid chamber of the tank.

BRIEF DESCRIPTION OF THE DRAWINGS

FIG. 14 is a flowchart of an image recording process;

FIGS. 18A and 18B are flowcharts of an image recording process according to the second embodiment;

DETAILED DESCRIPTION

Figure 1A:
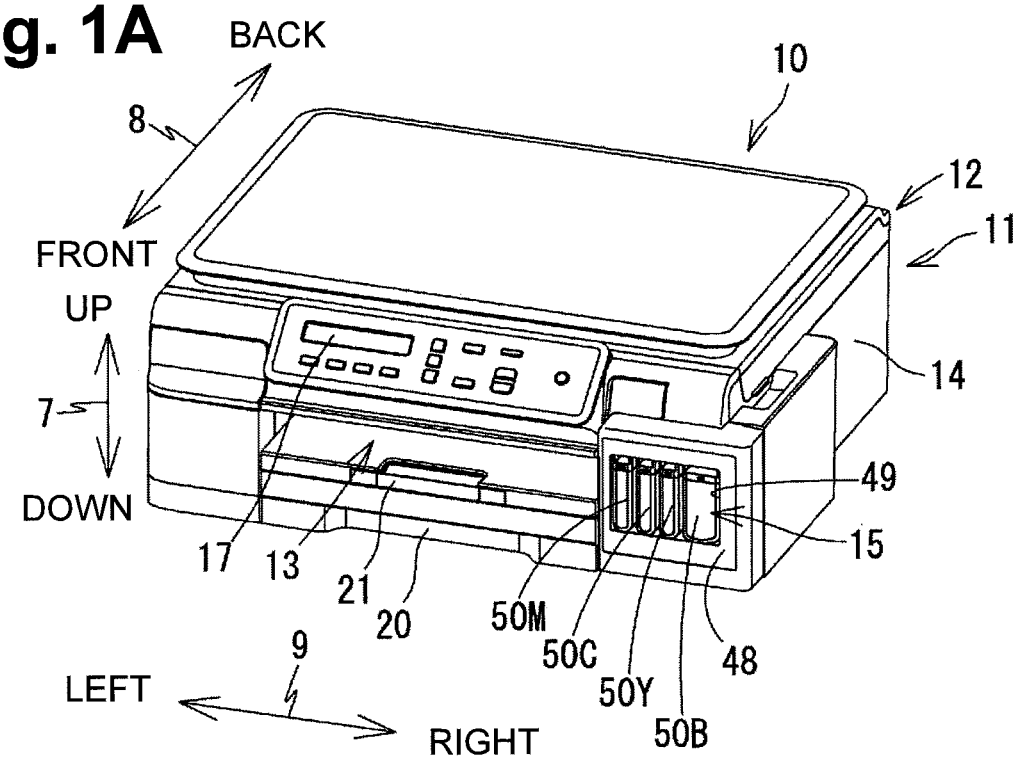
FIG. 1A is an external perspective view of a multifunction peripheral 10 according to a first embodiment with a cover 48 at a closed position.

Embodiments of the present disclosure will be described below. The embodiments described below are merely examples and can be appropriately modified without departing from the spirit and scope of the present disclosure. An up-down direction 7 is defined based on the posture of a multifunction peripheral 10 placed on a horizontal plane with ink cartridges 50 installed for use (posture in FIG. 1, hereinafter referred to as a use posture), a front-back direction 8 is defined using a surface of the multifunction peripheral 10 with an opening 13 as a front surface, and a left-right direction 9 is defined for the multifunction peripheral 10 viewed from the front surface. In the present embodiment, the up-down direction 7 in the use posture corresponds to a vertical direction, and the front-back direction 8 and the left-right direction 9 correspond to a horizontal direction.

First Embodiment

The multifunction peripheral 10 and an ink feeder 15 according to a first embodiment will now be described.

Overall Structure of Multifunction Peripheral 10

Figure 1B:
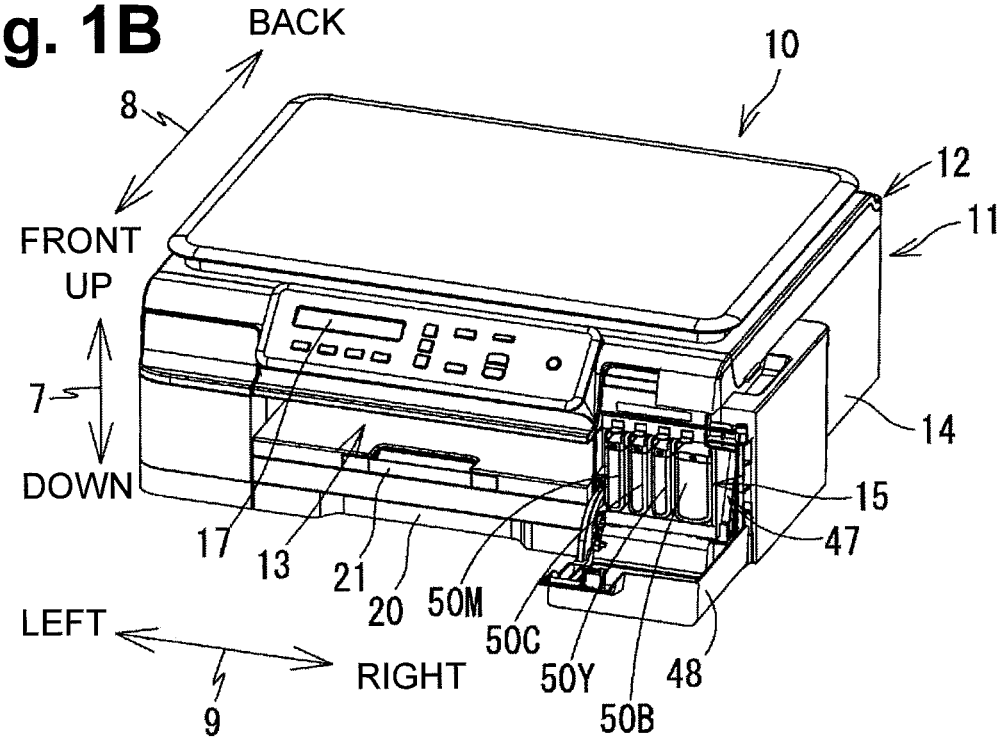
FIG. 1B is an external perspective view of the multifunction peripheral 10 with the cover 48 at an open position.

As shown in FIGS. 1A and 1B, the multifunction peripheral 10 (an example of a liquid discharge device) is in the shape of a substantially rectangular parallelepiped. The multifunction peripheral 10 includes a printer unit 11, a scanner unit 12, and an operation panel 22. The printer unit 11, which is a lower part of the multifunction peripheral 10, records an image on a sheet of paper (sheet 28) with an inkjet recording method (see FIG. 2). The scanner unit 12 with a scanning function is located above the printer unit 11. The printer unit 11 includes a housing 14 having a front opening 13, and the ink feeder 15 on the right of the opening 13 in the housing 14.

The operation panel 22 is located in front of the scanner unit 12. The operation panel 22 is operated by a user to cause the multifunction peripheral 10 to perform image recording by the printer unit 11 or image reading by the scanner unit 12. The operation panel 22 includes a display 17. The display 17 may be, for example, a liquid crystal display or an organic electroluminescence (EL) display, and has a display screen on which various items of information appear. The display 17 is an example of an alarm. However, the alarm is not limited to the display 17, and may be a speaker, a light-emitting diode (LED) lamp, or a combination of these devices. The operation panel 22 outputs an operation signal corresponding to a user's operation to a controller 230. For example, the operation panel 22 may include a push button, or may include a touch sensor overlaid on the display.

Figure 2:
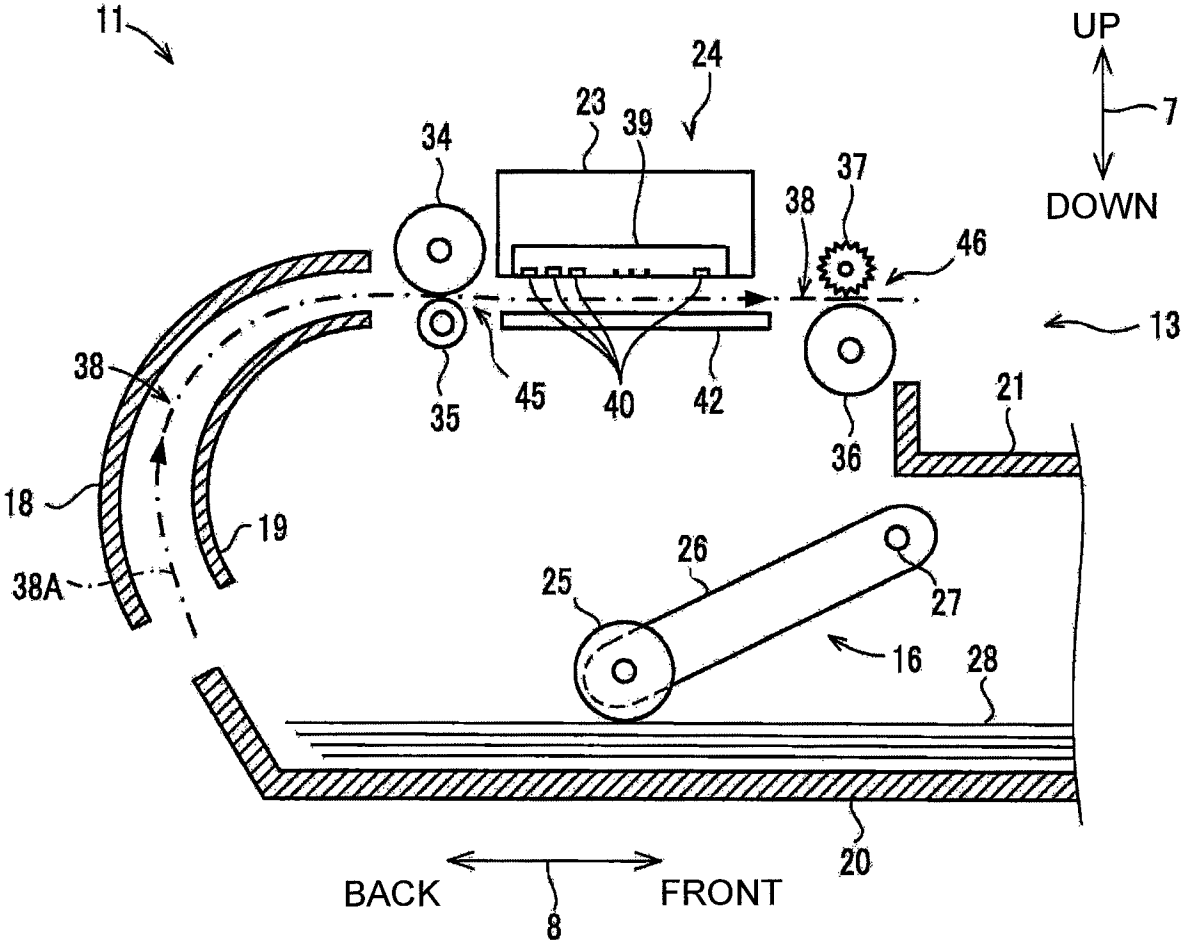
FIG. 2 is a sectional view of a printer unit 11 schematically showing the internal structure.

As shown in FIG. 2, the housing 14 contains a feeder 16, a feed tray 20, a discharge tray 21, a conveyance roller pair 45, a recorder 24, a discharge roller pair 46, and a platen 42.

Feed Tray 20 and Discharge Tray 21

As shown in FIGS. 1A and 1B, the feed tray 20 is insertable into and removable from the housing 14 in the front-back direction 8 through the opening 13. The opening 13 is located in the front surface of the multifunction peripheral 10 in the middle in the left-right direction 9. As shown in FIG. 2, the feed tray 20 can support a plurality of sheets 28 stacked on one another. The discharge tray 21 is located above the feed tray 20, and is inserted or removed in the front-back direction 8 together with the feed tray 20. The discharge tray 21 supports sheets 28 discharged from the discharge roller pair 46.

Feeder 16

The feeder 16 feeds a sheet 28 supported on the feed tray 20 to a conveyance path 38. As shown in FIG. 2, the feeder 16 includes a feed roller 25, a feed arm 26, and a shaft 27. The feed roller 25 is rotatably supported at an end of the feed arm 26. The feed roller 25 is driven by a feed motor (not shown). The feed arm 26 is rotatably supported by the shaft 27 that is supported by a frame of the printer unit 11. The feed arm 26 is rotationally urged toward the feed tray 20 by its weight or by an elastic force from a spring or another member.

Hereafter, the rotation of the feed roller 25, a conveyance roller 34, and a discharge roller 36 for conveyance of the sheet 28 in a conveyance direction 38A of the sheet 28 will be referred to as normal rotation.

Conveyance Path 38

Figure 3:
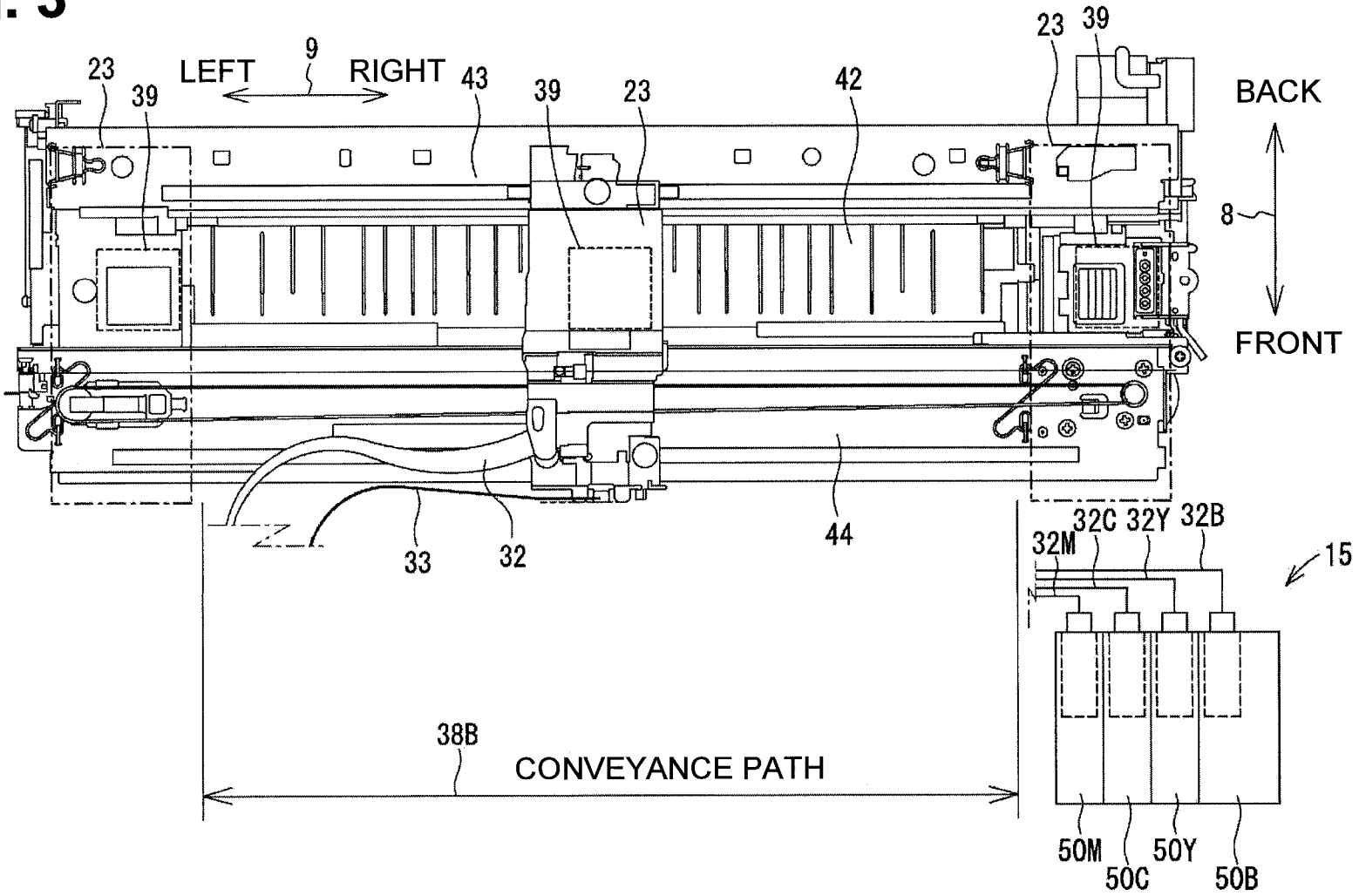
FIG. 3 is a plan view of a carriage 23 and an ink feeder 15 showing their arrangement.

As shown in FIG. 2, the conveyance path 38 is a space partially defined by an outer guide 18 and an inner guide 19 facing each other at a predetermined distance in the printer unit 11. The conveyance path 38 extends rearward from the rear end of the feed tray 20. The conveyance path 38 extends upward at the rear of the printer unit 11, U-turns, and extends forward through a space between the recorder 24 and the platen 42 into the discharge tray 21. As shown in FIGS. 2 and 3, a part of the conveyance path 38 between the conveyance roller pair 45 and the discharge roller pair 46 is located substantially in the middle of the multifunction peripheral 10 in the left-right direction 9, and extends in the front-back direction 8. The conveyance direction 38A of the sheet 28 on the conveyance path 38 is indicated by an arrow in FIG. 2.

Conveyance Roller Pair 45

As shown in FIG. 2, the conveyance roller pair 45 is located upstream from the recorder 24 in the conveyance direction 38A. The conveyance roller pair 45 includes the conveyance roller 34 and a pinch roller 35 facing each other. The conveyance roller 34 is driven by a conveyance motor (not shown) to rotate in normal or reverse direction. The pinch roller 35 rotates in accordance with the rotation of the conveyance roller 34. The sheet 28 is conveyed in the conveyance direction 38A between the conveyance roller 34 and the pinch roller 35 that are rotating in normal direction.

Discharge Roller Pair 46

As shown in FIG. 2, the discharge roller pair 46 is located downstream from the recorder 24 in the conveyance direction 38A. The discharge roller pair 46 includes the discharge roller 36 and a spur 37 facing each other. The discharge roller 36 is driven by the conveyance motor (not shown) to rotate in normal or reverse direction. The spur 37 rotates in accordance with the rotation of the discharge roller 36. The sheet 28 is conveyed in the conveyance direction 38A between the discharge roller 36 and the spur 37 that are rotating in normal direction.

Recorder 24

As shown in FIG. 2, the recorder 24 is located between the conveyance roller pair 45 and the discharge roller pair 46 in the conveyance direction 38A. The recorder 24 faces the platen 42 in the up-down direction 7 across the conveyance path 38. The recorder 24 includes a carriage 23 and a printhead 39 included in the carriage 23.

As shown in FIG. 3, the carriage 23 is supported by guide rails 43 and 44 spaced from each other in the front-back direction 8 and each extending in the left-right direction 9. The guide rails 43 and 44 are supported by a frame (not shown). The carriage 23 is connected to a known belt mechanism included in the guide rail 44. The belt mechanism is driven by a carriage drive motor (not shown) to rotate. As the belt mechanism rotates, the carriage 23 is guided by the guide rails 43 and 44 to reciprocate in the left-right direction 9. The carriage 23 moves beyond the right and left ends of a width 38B of the conveyance path 38, as indicated by dash-dot lines in FIG. 3.

The printhead 39 and four subtanks 100 included in the ink feeder 15 are connected to each other with four ink tubes 32. The printhead 39 is connected to a control board (not shown) with a flexible flat cable 33.

The four subtanks 100 include a magenta subtank 100M, a cyan subtank 100C, a yellow subtank 100Y, and a black subtank 100B. The magenta subtank 100M, the cyan subtank 100C, the yellow subtank 100Y, and the black subtank 100B are herein collectively referred to as the subtanks 100, unless they are distinguished.

The four ink tubes 32 include a yellow ink tube 32Y, a cyan ink tube 32C, a magenta ink tube 32M, and a black ink tube 32B. The yellow ink tube 32Y, the cyan ink tube 32C, the magenta ink tube 32M, and the black ink tube 32B are herein collectively referred to as the ink tubes 32, unless they are distinguished. The four ink tubes 32 are bundled together.

The flexible flat cable 33 electrically connects the control board including a control unit to the printhead 39. The flexible flat cable 33 transfers a control signal output from the control unit to the printhead 39.

As shown in FIG. 2, the printhead 39 includes a plurality of nozzles 40 on its bottom surface. The nozzles 40 have ends exposed at the bottom surface of the printhead 39. The printhead 39 discharges ink through the nozzles 40 as fine droplets. While the carriage 23 is moving, the printhead 39 discharges ink droplets toward the sheet 28 supported on the platen 42. This records an image on the sheet 28. In this process, the ink stored in the four subtanks 100 is used.

Platen 42

As shown in FIGS. 2 and 3, the platen 42 is located between the conveyance roller pair 45 and the discharge roller pair 46 on the conveyance path 38. The platen 42 faces the recorder 24 in the up-down direction 7 across the conveyance path 38. The platen 42 supports the sheet 28 from below when the conveyance roller pair 45 conveys the sheet 28.

Cover 48

As shown in FIG. 1B, the housing 14 has a front right opening 47. The housing 14 contains the ink feeder 15 with a front surface exposed at the opening 47. The housing 14 has a cover 48 attached to open and close the opening 47. The cover 48 has a lower end under the opening 47, which is pivotably supported by the housing 14 about an axis in the left-right direction 9. The cover 48 is pivotable between a closed position (shown in FIG. 1A) at which the opening 47 is closed and an open position (shown in FIG. 1B) at which the opening 47 is open.

As shown in FIG. 1A, the cover 48 has a translucent part 49. The translucent part 49 is translucent to allow the interior to be viewable from outside the cover 48. With the cover 48 at the closed position, the translucent part 49 allows viewing of the front surfaces of the ink cartridges 50 installed in the ink feeder 15.

Cover Sensor 88

Figure 13:
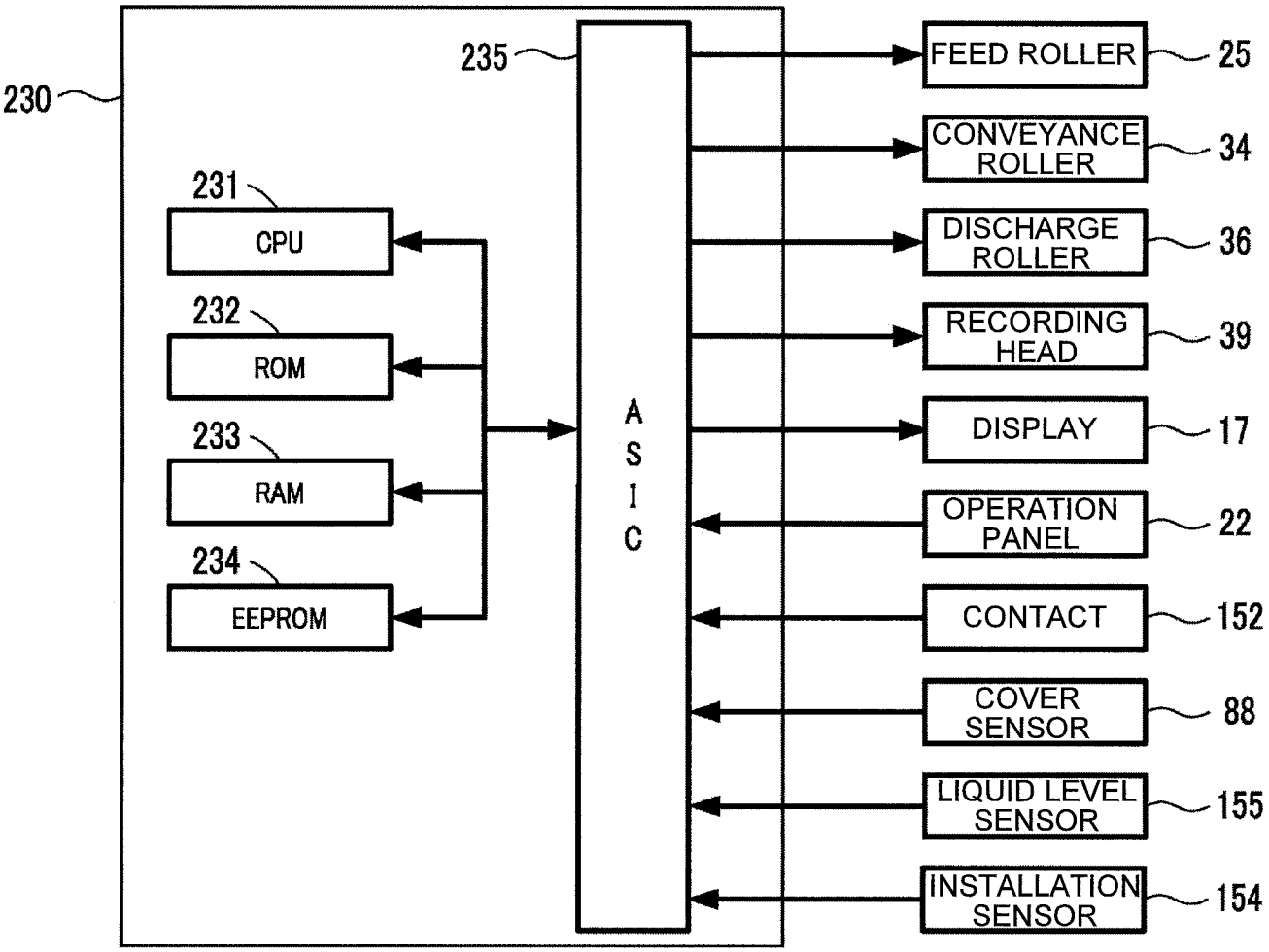
FIG. 13 is a block diagram of the multifunction peripheral 10.

The multifunction peripheral 10 includes a cover sensor 88 (see FIG. 13). The cover sensor 88 may be, for example, a mechanical sensor such as a switch with and from which the cover 48 contacts and separates, or an optical sensor for which light is blocked or transmitted depending on the position of the cover 48. The cover sensor 88 outputs a signal corresponding to the position of the cover 48 to the controller 230. More specifically, the cover sensor 88 outputs a low-level signal to the controller 230 when the cover 48 is at the closed position. The cover sensor 88 outputs a high-level signal having a higher signal intensity than the low-level signal to the controller 230 when the cover 48 is at a position different from the closed position. In other words, the cover sensor 88 outputs a high-level signal to the controller 230 when the cover 48 is at the open position.

Ink Feeder 15

Figure 4:
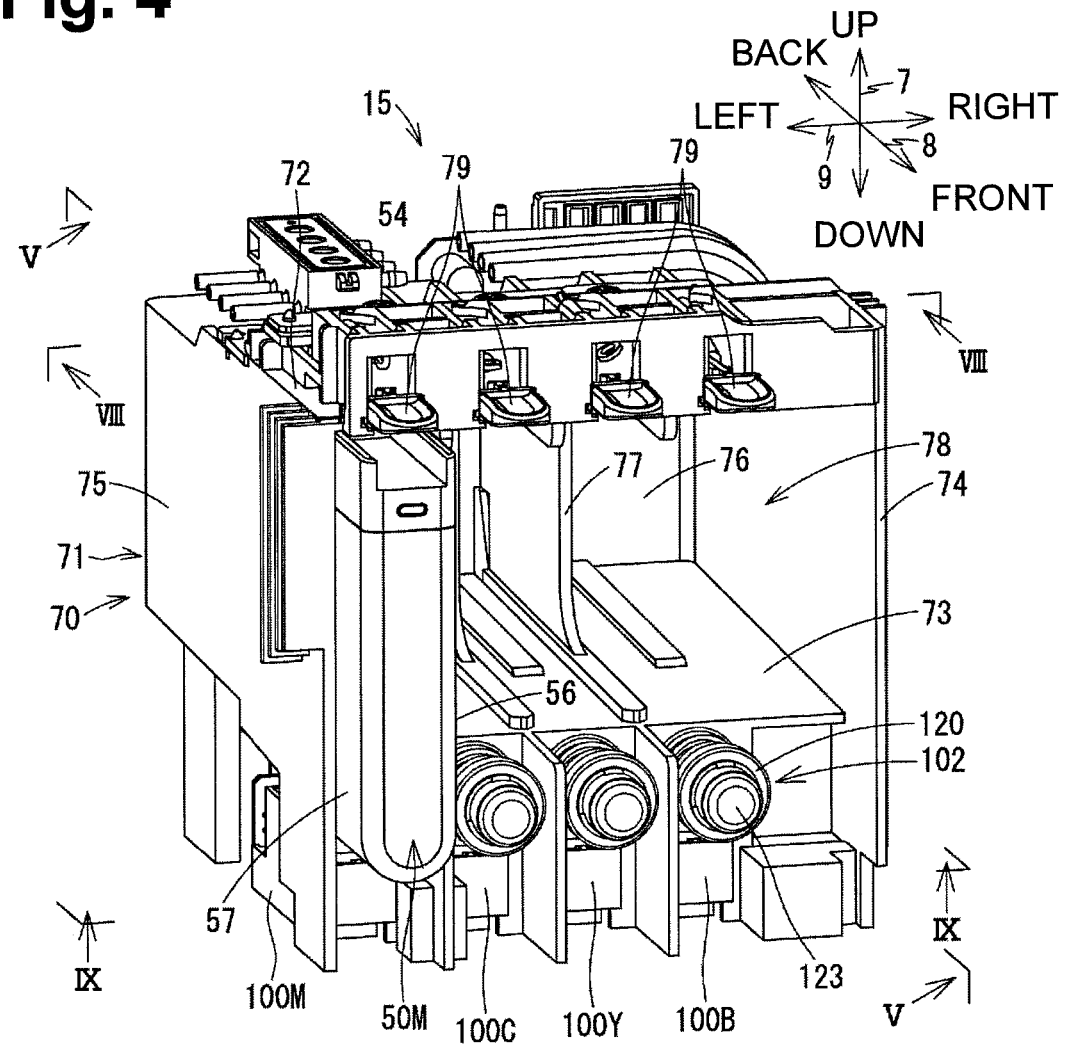
FIG. 4 is a perspective view of the ink feeder 15 viewed from the front left.
Figure 5:
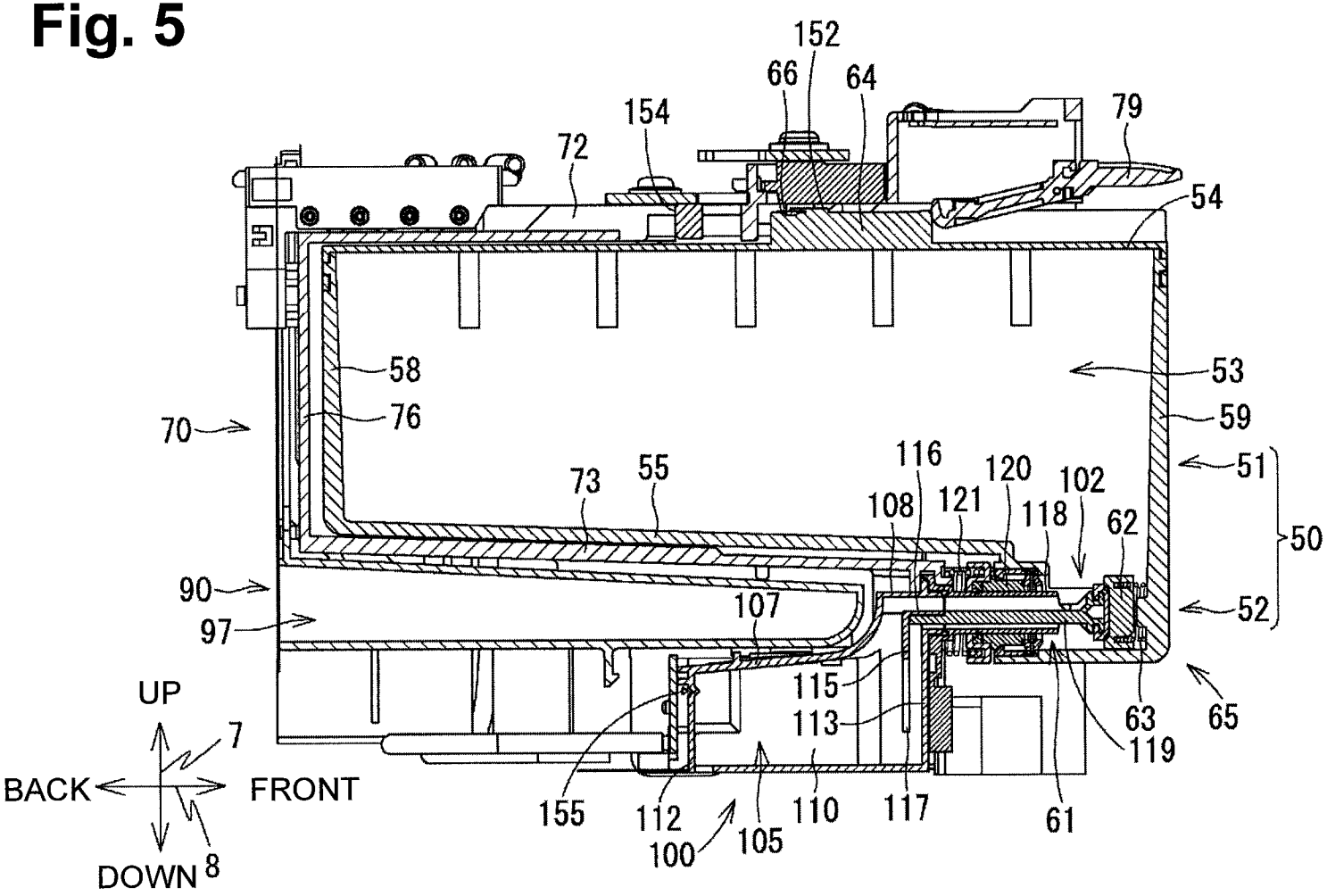
FIG. 5 is a cross-sectional view taken in the arrow direction of line V-V in FIG. 4.
Figure 11:
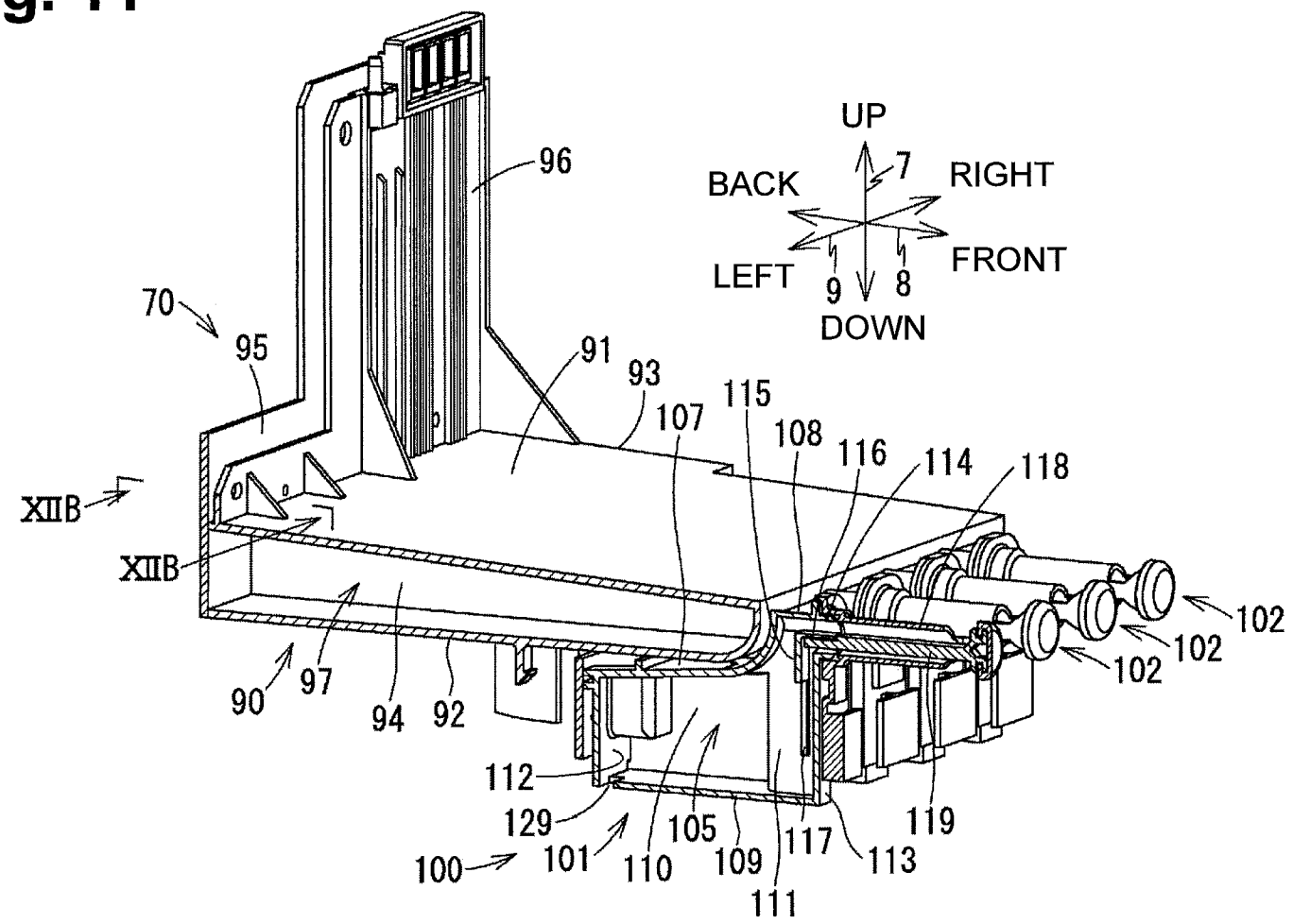
FIG. 11 is a perspective view of the subtank 100 and a buffer tank 90 viewed from the front left.

As shown in FIG. 4, the ink feeder 15 includes the four ink cartridges 50, an installation case 71, the four subtanks 100, and an air communication portion 70 (see FIGS. 5 and 11).

Ink Cartridge 50

As shown in FIGS. 1A, 1B, and 3, the four ink cartridges 50 (examples of cartridges) include a magenta ink cartridge 50M, a cyan ink cartridge 50C, a yellow ink cartridge 50Y, and a black ink cartridge 50B. The magenta ink cartridge 50M, the cyan ink cartridge 50C, the yellow ink cartridge 50Y, and the black ink cartridge 50B are herein collectively referred to as the ink cartridges 50, unless they are distinguished.

In FIG. 4, the magenta ink cartridge 50M, which is the leftmost one of the four ink cartridges 50 in the left-right direction 9, alone is installed in the installation case 71.

Figure 6:
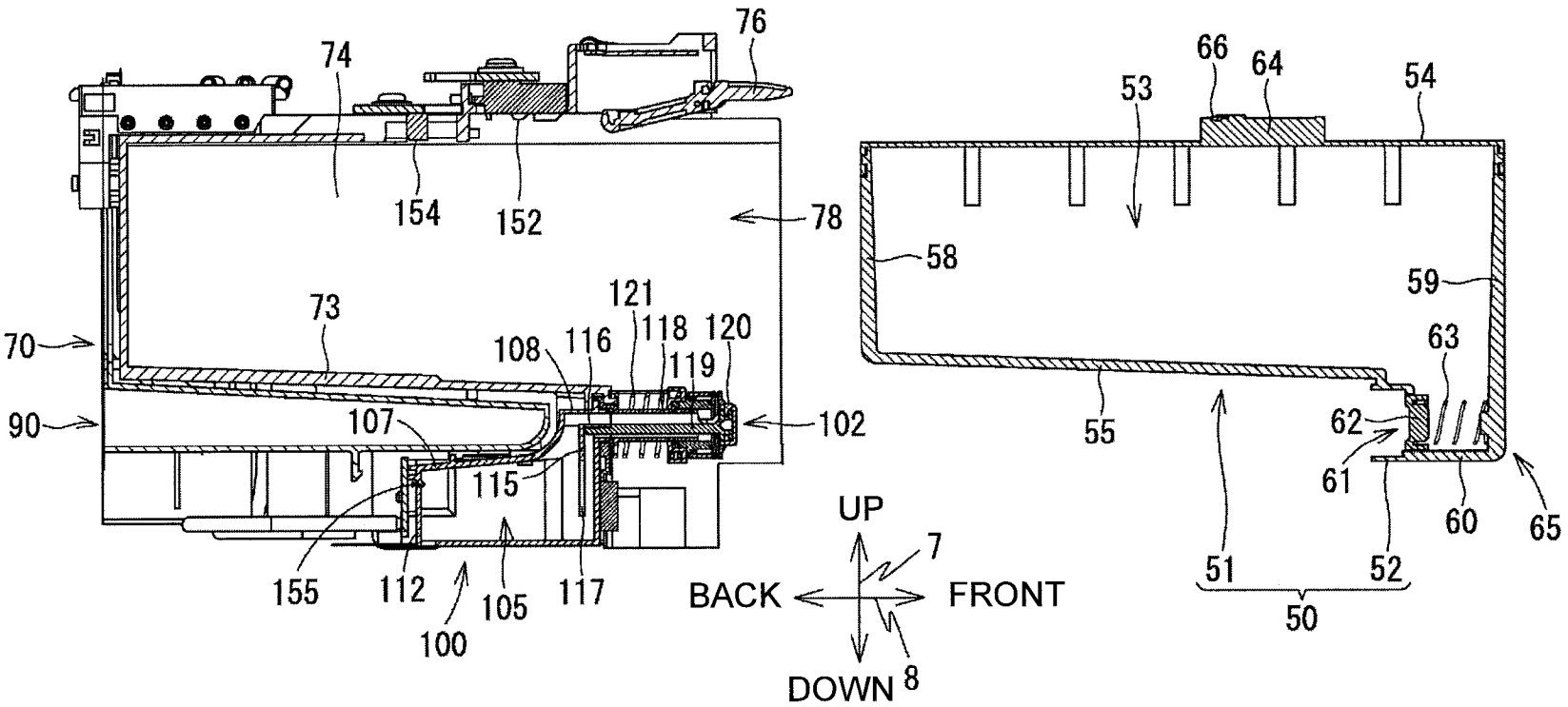
FIG. 6 is a cross-sectional view taken in the arrow direction of line V-V in FIG. 4 with an ink cartridge 50 removed.

As shown in FIGS. 5 and 6, an ink cartridge 50 includes a cartridge body 51 and a joint receiver 52. The cartridge body 51 includes a first reservoir 53 (an example of a first liquid chamber) storing ink (an example of liquid).

The cartridge body 51 is in the shape of a substantially rectangular parallelepiped box. The cartridge body 51 is substantially rectangular as viewed in the up-down direction 7 and the front-back direction 8. The cartridge body 51 has a downward protrusion 65 on its front end. The cartridge body 51 has an upper wall 54, a lower subwall 55, a right wall 56 (see FIG. 4), a left wall 57 (see FIG. 4), a rear wall 58, a front wall 59, and a lower wall 60. The lower wall 60 is located at the front part and the lower end of the cartridge body 51, and below the lower subwall 55. The lower subwall 55 is located behind the lower wall 60. The cartridge body 51 has a communication port 61 that is open rearward (an example of a horizontal direction) in the protrusion 65. The communication port 61 is an opening defined by the lower subwall 55, the lower wall 60, the right wall 56, and the left wall 57.

The upper wall 54 has a contact part 64 protruding upward in the middle in the front-back direction 8. The contact part 64 comes into contact with a lock lever 79 (described later) on the installation case 71.

The contact part 64 receives an integrated circuit (IC) chip 66 (an example of a cartridge memory) on its upper surface. The IC chip 66 includes an IC chip. The IC chip 66 also includes a memory (not shown). In the IC chip 66, the IC chip is electrically connected to the memory. The IC chip 66 is exposed on its upper surface for electrical connection with a contact 152. More specifically, the IC chip 66 is electrically connected to the contact 152 when the ink cartridge 50 is installed in the installation case 71. The controller 230 can read information from the memory of the IC chip 66 through the contact 152 and the IC chip 66, and can write information to the memory of the IC chip 66 through the contact 152 and the IC chip 66.

The memory of the IC chip 66 stores an ink amount Vc and identification information for identifying each ink cartridge 50. For a fresh ink cartridge 50, the memory of the IC chip 66 stores an initial ink amount Vc0 as the ink amount Vc. The initial ink amount Vc0 is an example of a maximum liquid amount indicating a maximum amount of ink that can be stored in the ink cartridge 50. In other words, the initial ink amount Vc0 indicates the amount of ink stored in a fresh ink cartridge 50. Hereafter, information stored in the memory of the IC chip 66 may be collectively referred to as cartridge (CTG) information. A fresh ink cartridge herein refers to an unused ink cartridge 50 from which ink has yet to flow out after manufactured and sold.

The memory of the IC chip 66 includes, for example, a non-writable storage area in which no information is overwritten by the controller 230 and a writable storage area in which information can be overwritten by the controller 230. For example, identification information is stored in the non-writable area, and the ink amount Vc is stored in the writable area.

The upper surface of the lower subwall 55, which defines the bottom surface of the first reservoir 53, is inclined downward to the protrusion 65 in the front-back direction 8.

The joint receiver 52 is cylindrical and extends rearward from a part of the cartridge body 51 surrounding the communication port 61. The joint receiver 52 receives a joint 102 (described later) included in a subtank 100.

FIG. 5 shows the ink cartridge 50 installed in the subtank 100. FIG. 6 shows the ink cartridge 50 separate from the subtank 100. The installed state will be detailed later.

The joint receiver 52 includes a plug 62 that can close the communication port 61 and a spring 63 that urges the plug 62 rearward. As shown in FIG. 6, under no external force applied to the ink cartridge 50, the plug 62 is located to close the communication port 61. The spring 63 extends in the front-back direction 8 between the plug 62 and the front wall 59, and can be compressed in the front-back direction 8. As shown in FIG. 5, when receiving a forward external force greater than the elastic force of the spring 63 from the joint 102, the plug 62 moves forward to leave the communication port 61.

Installation Case 71

The installation case 71 is in the shape of a substantially rectangular parallelepiped box that is open forward. The installation case 71 has an upper wall 72, a lower wall 73, a right wall 74, a left wall 75, a rear wall 76, and three partition walls 77. The upper wall 72, the lower wall 73, the right wall 74, the left wall 75, and the rear wall 76 define an internal space 78 opening forward. The three partition walls 77 are parallel with the right wall 74 and the left wall 75, and partition the internal space 78 into four spaces. Each of the four partition spaces receives the corresponding one of the four ink cartridges 50.

Lock Lever 79

As shown in FIGS. 4, 5, and 6, the installation case 71 includes lock levers 79 that hold the ink cartridges 50 inside the internal space 78. The lock levers 79 are plate-like members extending in the front-back direction. Each lock lever 79 is pivotably attached, at the center, to the upper wall 72 about an axis in the left-right direction 9. The lock lever 79 pivots between a locked position inclined rearward and an unlocked position inclined forward. Under no external force applied, the lock lever 79 is inclined rearward to the locked position with its weight. The lock lever 79 at the locked position has the rear end in contact with the front surface of the contact part 64 of the ink cartridge 50 inside the internal space 78 to prevent the ink cartridge 50 from moving forward in the front-back direction 8. When the front end of the lock lever 79 at the locked position is depressed with, for example, a finger of the user, the lock lever 79 pivots from the locked position to the unlocked position. The lock lever 79 at the unlocked position has the rear end located above the front surface of the contact part 64. The lock lever 79 at the unlocked position is not in contact with the contact part 64 of the ink cartridge 50 moving forward in the front-back direction 8, thus allowing the ink cartridge 50 to be removable from the installation case 71.

Contact 152

The contact 152 (an example of an interface) is located on the upper wall 72 of the installation case 71. The contact 152 protrudes downward toward the internal space 78 of the installation case 71 from the upper wall 72. The contact 152 is located to be in contact with the IC chip 66 (described below) of the ink cartridge 50 when the ink cartridge 50 is installed in the installation case 71. The contact 152 is conductive and elastically deformable in the up-down direction 7. The contact 152 is electrically connected to the controller 230.

Installation Sensor 154

The installation sensor 154 is located on the upper wall 72 of the installation case 71. The installation sensor 154 detects the ink cartridge 50 installed in the installation case 71. The installation sensor 154 includes a light emitter and a light receiver located at a distance from each other in the left-right direction 9. When the ink cartridge 50 is installed in the installation case 71, a detectable unit (not shown) of the ink cartridge 50 is located between the light emitter and the light receiver of the installation sensor 154. In other words, the light emitter and the light receiver of the installation sensor 154 are located opposite to each other across the detectable unit of the ink cartridge 50 installed in the installation case 71.

The installation sensor 154 outputs different signals (installation signals in the drawings) depending on whether light emitted from the light emitter in the left-right direction 9 is received by the light receiver. The installation sensor 154 outputs a low-level signal to the controller 230 when, for example, the intensity of the light received by the light receiver is lower than a threshold intensity. In contrast, the installation sensor 154 outputs a high-level signal having a higher signal intensity than the low-level signal to the controller 230 when the intensity of the light received by the light receiver is equal to or higher than the threshold intensity. The high-level signal is an example of a third signal, and the low-level signal is an example of a fourth signal.

Subtank 100

FIGS. 4 to 11 show the subtanks 100 (examples of tanks). The subtanks 100 are located under the lower wall 73 of the installation case 71.

Figure 7:
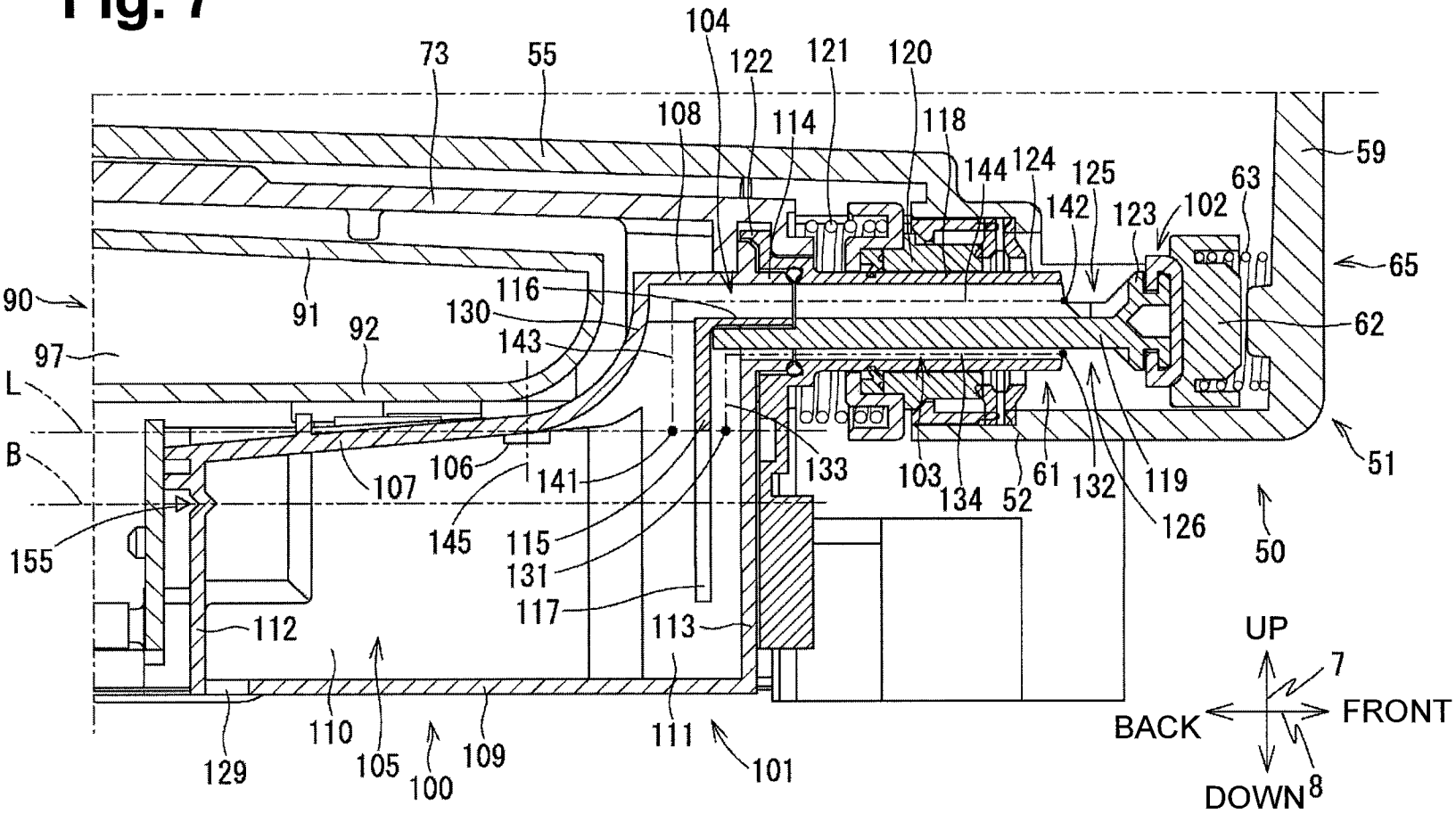
FIG. 7 is a cross-sectional view taken in the arrow direction of line V-V in FIG. 4 showing a part around a subtank 100.

As shown in FIG. 7, each subtank 100 includes a tank body 101 and the joint 102. The tank body 101 includes an internal second reservoir 105 (an example of a second liquid chamber) to store ink. The subtank 100 includes a liquid flow path 103 and a gas flow path 104 that communicate with the second reservoir 105. The liquid flow path 103 and the gas flow path 104 are defined inside the tank body 101 and the joint 102. The subtank 100 also includes an air communication port 106 (see FIGS. 9, 10, and 12A) that allows the second reservoir 105 to communicate with the outside.

Liquid Flow Path 103 and Gas Flow Path 104

As shown in FIG. 7, the liquid flow path 103 and the gas flow path 104 are located in parallel.

The liquid flow path 103 has a first opening 131, a second opening 132, a vertical part 133, and a horizontal part 134. The first opening 131 is formed in one end (rear end) of the liquid flow path 103 and communicates with the second reservoir 105. The first opening 131 is open in the up-down direction 7. The second opening 132 is formed in the opposite end (front end) of the liquid flow path 103 and is open to the outside. The second opening 132 is open in the front-back direction 8. With the ink cartridge 50 installed, the second opening 132 is located in the first reservoir 53 of the ink cartridge 50. The vertical part 133 is a part of the liquid flow path 103 extending upward from the first opening 131. The horizontal part 134 is a part of the liquid flow path 103 extending rearward from the second opening 132. The upper end of the vertical part 133 is connected to the rear end of the horizontal part 134.

The gas flow path 104 has a third opening 141, a fourth opening 142, a vertical part 143, and a horizontal part 144. The third opening 141 is formed in one end (rear end) of the gas flow path 104 and communicates with the second reservoir 105. The third opening 141 is open in the up-down direction 7. The fourth opening 142 is formed in the opposite end (front end) of the gas flow path 104 and is open to the outside. The fourth opening 142 is open in the front-back direction 8. With the ink cartridge 50 installed, the fourth opening 142 communicates with the first reservoir 53 of the ink cartridge 50. The vertical part 143 is a part of the gas flow path 104 extending upward from the third opening 141. The horizontal part 144 is a part of the gas flow path 104 extending rearward from the fourth opening 142. The upper end of the vertical part 143 is connected to the rear end of the horizontal part 144.

Tank Body 101

The tank body 101 has outer walls defining the shape of a substantial rectangular parallelepiped. The tank body 101 is substantially T-shaped as viewed in the up-down direction 7 (see FIGS. 9 and 10), substantially rectangular as viewed in the front-back direction 8 (see FIG. 8), and L-shaped as viewed in the left-right direction 9 (see FIGS. 4 to 7).

Figure 8:
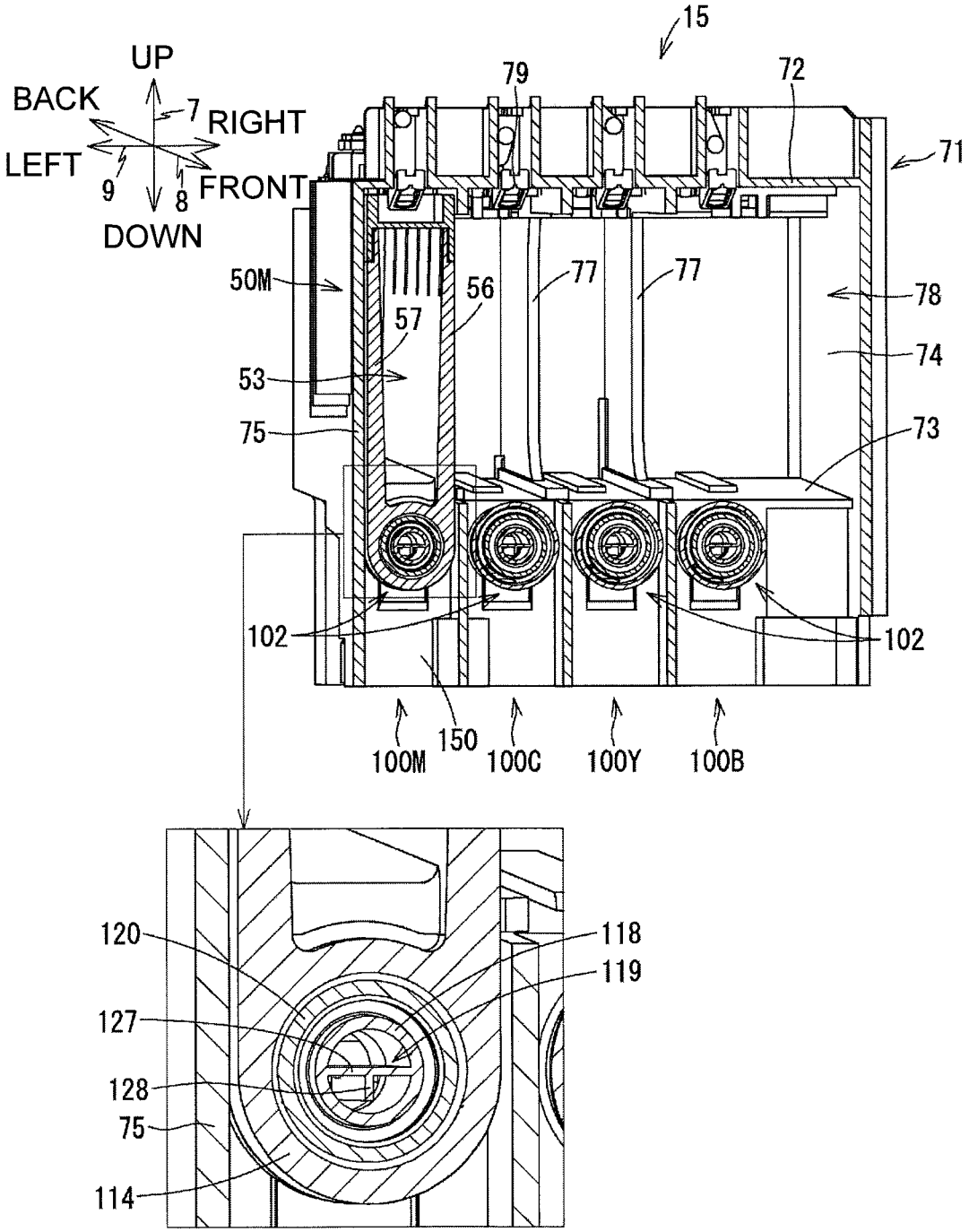
FIG. 8 is a cross-sectional view taken in the arrow direction of line VIII-VIII in FIG. 4.
Figure 9:
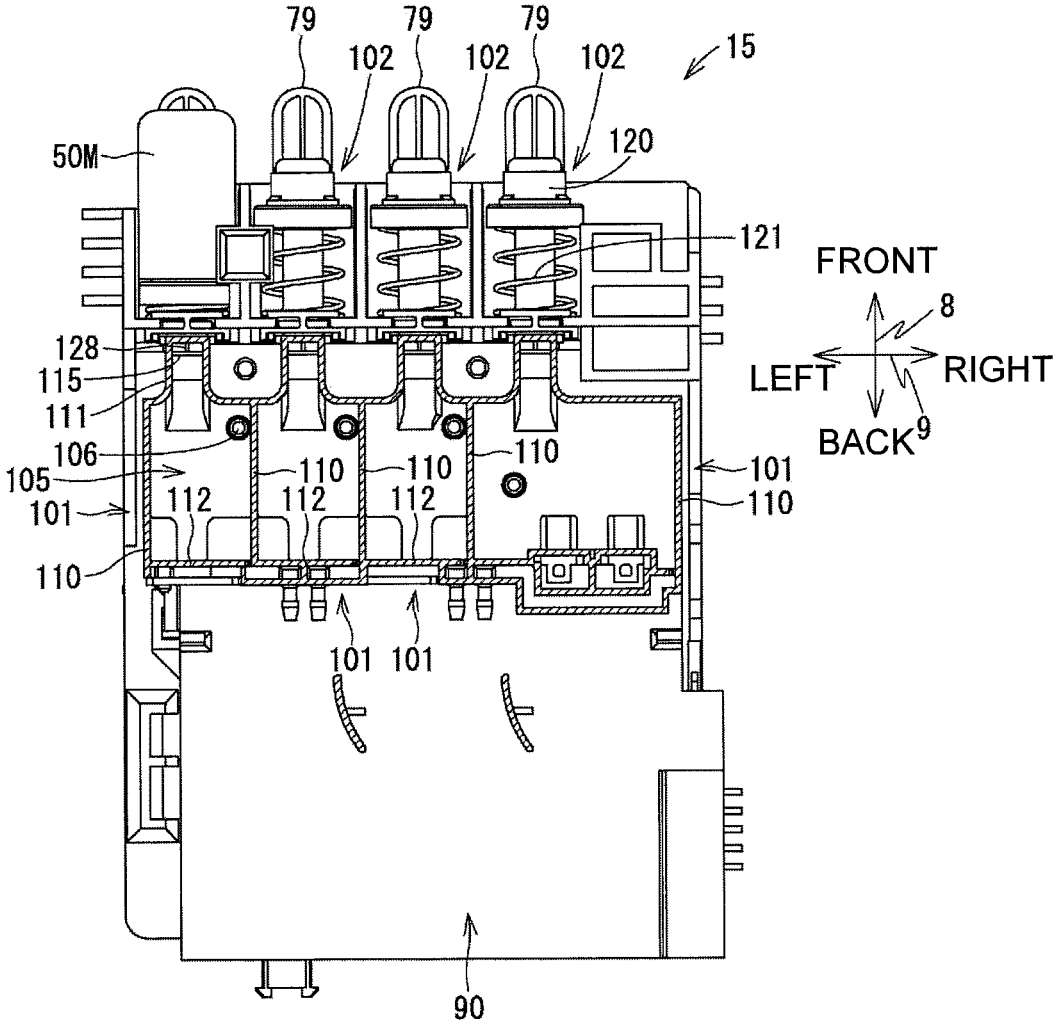
FIG. 9 is a cross-sectional view taken in the arrow direction of line IX-IX in FIG. 4.

As shown in FIGS. 4 to 11, the outer walls of the tank body 101 include a rear upper wall 107, a curved upper wall 130, a front upper wall 108, a lower wall 109, two rear side walls 110, two front curved side walls 111, a rear wall 112, and a front wall 113. The rear upper wall 107 extends forward from the rear end and is inclined upward with respect to the horizontal plane. The curved upper wall 130 extends from the front end of the rear upper wall 107 and curves upward as it extends forward. The front upper wall 108 extends from the upper end of the curved upper wall 130 forward in parallel with the horizontal plane. The lower wall 109 extends in the front-back direction 8 in parallel with the horizontal plane. The lower wall 109 is T-shaped as viewed in the up-down direction 7. The rear side walls 110 connect the rear upper wall 107 and the lower wall 109 in the up-down direction 7. The rear side walls 110 are substantially rectangular as viewed in the left-right direction 9. As shown in FIG. 9, adjacent tank bodies 101 for different inks share one rear side wall 110. The front curved side walls 111 connect the curved upper wall 130 and the front upper wall 108 to the lower wall 109 in the up-down direction 7. The front curved side walls 111 are substantially rectangular as viewed in the left-right direction 9, and L-shaped with a round corner as viewed in the up-down direction 7. The rear wall 112 extends upward from the rear end of the lower wall 109, and is connected to the two right and left rear side walls 110 and the rear upper wall 107. The front wall 113 extends upward from the front end of the lower wall 109, and is connected to the two right and left front curved side walls 111.

As shown in FIGS. 7 and 11, the lower wall 109 has a communication port 129 that communicates with the second reservoir 105. The communication port 129 is connected to one end of the ink tube 32, and the ink tube 32 connects the second reservoir 105 and the printhead 39.

The tank body 101 includes an inner cylinder 114 extending in the front-back direction 8 at the front end and the upper part of the tank body 101. The inside of the inner cylinder 114 communicates with the opening defined by the front wall 113, the two right and left front curved side walls 111, and the front upper wall 108. The rear end of the joint 102 is attachable to the inner cylinder 114. In the installed state with the joint 102 attached to the inner cylinder 114, the inside of the inner cylinder 114 communicates with the inside of the joint 102.

Wide Part 150 and Narrow Part 151

Figure 10:
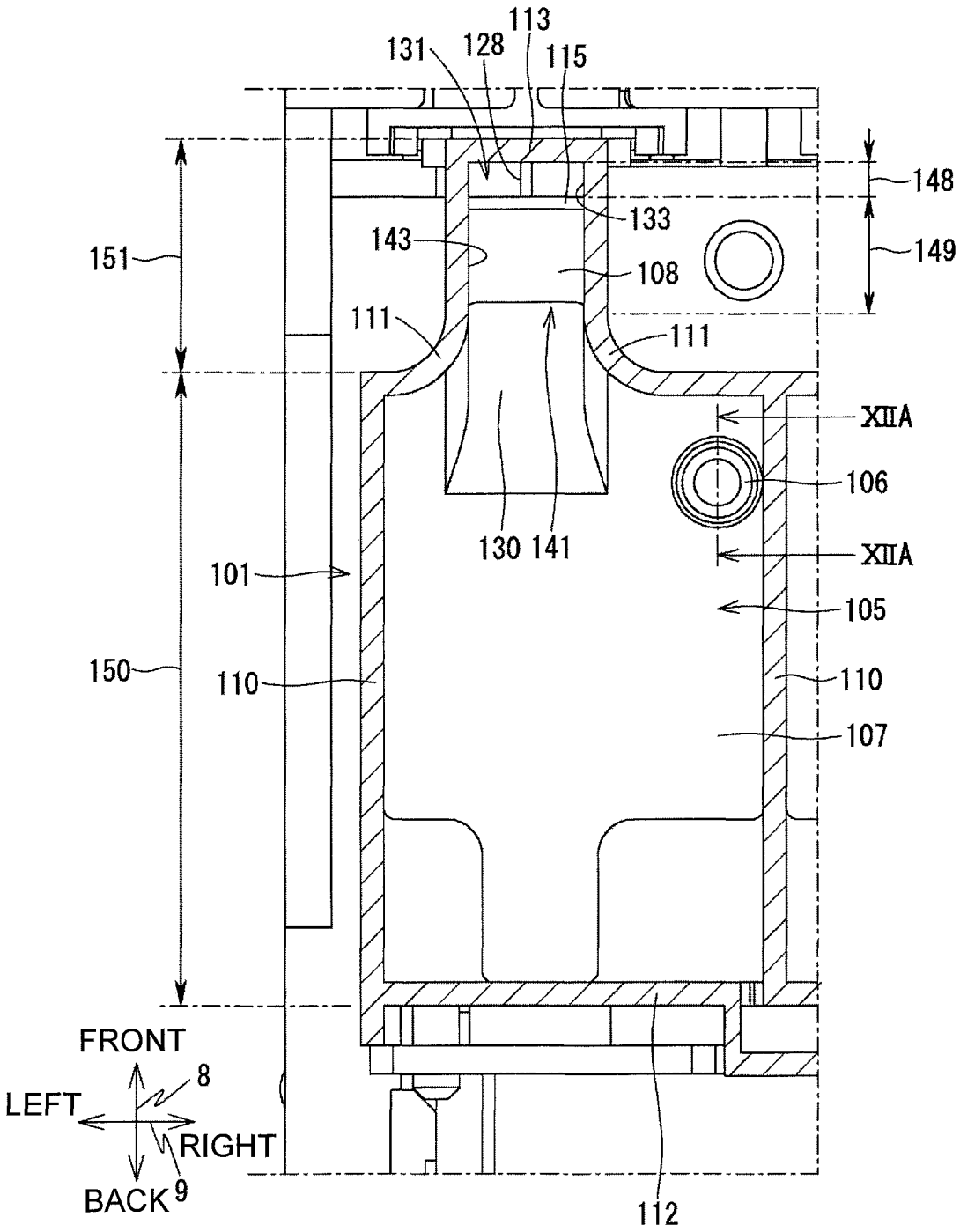
FIG. 10 is a cross-sectional view taken in the arrow direction of line IX-IX in FIG. 4 showing a part around the subtank 100.

As shown in FIG. 10, the tank body 101 has a wide part 150 and a narrow part 151 aligned with each other in the front-back direction 8. The wide part 150 is a rear part in the tank body 101 in the front-back direction 8 and includes the two rear side walls 110 and the rear wall 112. The narrow part 151 is located at the front end in the front-back direction 8 (an example of an end in a first direction) in the tank body 101 and includes the two front curved side walls 111 and the front wall 113. The narrow part 151 has a width in the left-right direction 9 (an example of a second direction orthogonal to the first direction) smaller than the width of the wide part 150 in the left-right direction 9. The second reservoir 105 extends across the wide part 150 and the narrow part 151.

As shown in FIG. 8, the width of the wide part 150 in the left-right direction 9 is substantially the same as the width of the ink cartridge 50 in the left-right direction 9. Thus, the width of the narrow part 151 in the left-right direction 9 is smaller than the width of the ink cartridge 50 in the left-right direction 9.

Vertical Wall 115 and Horizontal Wall 116

As shown in FIGS. 7 and 11, the tank body 101 includes a vertical wall 115 and a horizontal wall 116 in the upper front part of the tank body 101.

The vertical wall 115 extends in the up-down direction 7 and is located between the front wall 113 and the curved upper wall 130 in the front-back direction 8. The vertical wall 115 connects the two right and left front curved side walls 111, and partitions the space defined by the front wall 113, the front upper wall 108, and the two front curved side walls 111 into front and rear parts. The lower end position of the vertical wall 115 is a position at the first opening 131 of the liquid flow path 103 in the up-down direction 7, and also a position at the third opening 141 of the gas flow path 104 in the up-down direction 7. The lower end position of the vertical wall 115 is equal to the lower end position of the front end of the rear upper wall 107. More specifically, the upper surface of the second reservoir 105 is defined by an imaginary plane on the lower end position of the vertical wall 115 and parallel with the horizontal plane, and the bottom surface of the rear upper wall 107.

The horizontal wall 116 extends forward from the upper end of the vertical wall 115. The horizontal wall 116 extends into the inner cylinder 114. The horizontal wall 116 connects the two right and left front curved side walls 111, and also connects the facing inner surfaces inside the inner cylinder 114 in the left-right direction 9. The horizontal wall 116 partitions the space defined by the front upper wall 108 and the two front curved side walls 111 into upper and lower parts, and also partitions the space defined by the inner cylinder 114 into upper and lower parts.

As shown in FIG. 10, the vertical part 133 of the liquid flow path 103 is defined by the vertical wall 115, the front wall 113, and the two front curved side walls 111. The vertical part 133 of the liquid flow path 103 has a rectangular cross section orthogonal to the up-down direction 7. The vertical part 133 of the liquid flow path 103 is flush with the two front curved side walls 111 defining the second reservoir 105. Thus, the vertical part 133 of the liquid flow path 103 has a width in the left-right direction 9 equal to the width of the second reservoir 105 defined by the narrow part 151 in the left-right direction 9.

As shown in FIG. 10, the vertical part 143 of the gas flow path 104 is defined by the curved upper wall 130, the vertical wall 115, and the two front curved side walls 111. The vertical part 143 of the gas flow path 104 has a rectangular cross section orthogonal to the up-down direction 7. The vertical part 143 of the gas flow path 104 is flush with the two front curved side walls 111 defining the second reservoir 105. Thus, the vertical part 143 of the gas flow path 104 has a width in the left-right direction 9 equal to the width of the second reservoir 105 defined by the narrow part 151 in the left-right direction 9.

As shown in FIG. 10, the third opening 141 of the gas flow path 104 has a length 149 in the front-back direction 8 (an example of the horizontal direction), and the first opening 131 of the liquid flow path 103 has a length 148 in the front-back direction 8 (an example of the horizontal direction). The length 149 is greater than the length 148. The third opening 141 of the gas flow path 104 has a length in the left-right direction 9 equal to the length of the first opening 131 of the liquid flow path 103 in the left-right direction 9. Thus, the third opening 141 of the gas flow path 104 has a larger opening area than the first opening 131 of the liquid flow path 103.

As shown in FIG. 7, the opening area of the gas flow path 104 in the vertical part 143 of the gas flow path 104 increases toward the third opening 141 of the gas flow path 104. In the vertical part 133 of the liquid flow path 103, the opening area of the liquid flow path 103 remains constant in the up-down direction 7.

As shown in FIG. 7, the horizontal part 134 of the liquid flow path 103 in the tank body 101 is defined by the front upper wall 108, the horizontal wall 116, the two front curved side walls 111, and the inner cylinder 114. The horizontal part 144 of the gas flow path 104 in the tank body 101 is defined by the horizontal wall 116, the two front curved side walls 111, and the inner cylinder 114.

First Rib 117

As shown in FIGS. 7 and 11, the tank body 101 includes a first rib 117 connected to the vertical wall 115. The first rib 117 protrudes from a front curved side wall 111 and extends downward from the vertical wall 115. The first rib 117 is separate from the lower wall 109. Each of the two right and left front curved side walls 111 has the first rib 117. The single second reservoir 105 includes the two first ribs 117 separate from each other in the left-right direction 9.

Liquid Level Sensor 155

As shown in FIG. 7, a liquid level sensor 155 detects the liquid level of the second reservoir 105 of the tank body 101 equal to or higher than a predetermined level B. The predetermined level B is lower than an imaginary line L extending through the third opening 141 of the gas flow path 104 in the horizontal direction. The liquid level sensor 155 optically detects the liquid level of the ink in the second reservoir 105 at the predetermined level B using a prism with different reflectance values depending on whether the ink is in contact with the rear wall 112 of the tank body 101 at the predetermined level B.

The liquid level sensor 155 includes a light emitter and a light receiver located at a distance from each other in the left-right direction 9. The liquid level sensor 155 outputs different signals (liquid level signals in the drawings) depending on whether light output from the light emitter is received by the light receiver. In the present embodiment, when the second reservoir 105 of the tank body 101 has a liquid level equal to or higher than the predetermined level B, the liquid level sensor 155 outputs a low-level signal. When the second reservoir 105 of the tank body 101 has a liquid level lower than the predetermined level B, the liquid level sensor 155 outputs a high-level signal. The low-level signal is an example of a first signal. The high-level signal is an example of a second signal.

Joint 102

As shown in FIGS. 4 to 9 and 11, the joint 102 includes a joint body 118, an inner wall 119, a plug 120 (see FIGS. 6 and 7), and a spring 121 (see FIGS. 6 and 7).

Joint Body 118

As shown in FIG. 7, the joint body 118 includes an external cylinder 122 at its rear end, a front end 123, and a main body 124 connecting the external cylinder 122 and the front end 123. The external cylinder 122 is cylindrical and extends in the front-back direction 8. The external cylinder 122 is fitted in the inner cylinder 114 of the tank body 101. This fixes the joint body 118 to the tank body 101. The front end 123 is disc-shaped with the center at an axis in the front-back direction 8. The main body 124 is cylindrical and extends in the front-back direction 8. The main body 124 has an upper opening 125 facing upward and a lower opening 126 facing downward at the front end of the main body 124.

Partition Wall 127 and Second Rib 128

As shown in FIGS. 7 and 8, the inner wall 119 is located inside the joint body 118. The inner wall 119 extends rearward from the front end 123 beyond the external cylinder 122. The inner wall 119 has a partition wall 127 and a second rib 128. As shown in FIG. 8, the inner wall 119 is T-shaped as viewed in the front-back direction 8. The partition wall 127 has a rear end surface in contact with the front end surface of the horizontal wall 116 in the tank body 101. The partition wall 127 and the horizontal wall 116 partition the internal space of the connection part between the joint body 118 and the tank body 101 into the liquid flow path 103 and the gas flow path 104.

The partition wall 127 extends across the inside of the joint body 118 in the left-right direction 9. The partition wall 127 extends rearward from the front end 123. The joint body 118 has an internal space partitioned by the partition wall 127 into upper and lower parts.

The second rib 128 protrudes downward from the middle of the partition wall 127 in the left-right direction 9. The second rib 128 extends rearward from the front end 123. The second rib 128 and the joint body 118 have a gap between them.

The horizontal part 134 of the liquid flow path 103 in the joint 102 is defined by the inner surface of the joint body 118 and the bottom surface of the inner wall 119. The horizontal part 134 of the liquid flow path 103 in the joint 102 has a substantially semicircular cross section. More specifically, the cross section of the horizontal part 134 has a semicircular shape with an upper part divided by the second rib 128 into right and left areas, and a continuous lower part that is not divided into right and left areas. The horizontal part 144 of the gas flow path 104 in the joint 102 is defined by the inner surface of the joint body 118 and the upper surface of the inner wall 119. The horizontal part 144 of the gas flow path 104 in the joint 102 has a semicircular cross section.

Plug 120 and Spring 121

The plug 120 is a cylindrical member and located outside the main body 124 of the joint body 118. The plug 120 is movable in the front-back direction 8 along the main body 124. The spring 121 has a front end fixed to the rear end of the plug 120, and a rear end in contact with a buffer tank 90 in the air communication portion 70 and the external cylinder 122 of the joint body 118. The spring 121 urges the plug 120 forward. Under no external force applied, the plug 120 is located at the front end of the joint body 118 and closes the upper opening 125 and the lower opening 126. Under a rearward external force greater than the elastic force of the spring 121 applied, the plug 120 moves rearward to open the upper opening 125 and the lower opening 126. When the ink cartridge 50 is installed, the joint receiver 52 of the ink cartridge 50 comes into contact with the plug 120. Under the external force applied during the installation of the ink cartridge 50, the plug 120 in contact with the joint receiver 52 moves rearward.

Installed State of Ink Cartridge 50

In the installed state of the ink cartridge 50 installed in the subtank 100 as shown in FIGS. 5 and 7, the joint body 118 of the subtank 100 is inserted in the joint receiver 52 of the ink cartridge 50 in the front-back direction 8 and further in the communication port 61. In this installed state, the second opening 132 of the liquid flow path 103 and the fourth opening 142 of the gas flow path 104 in the subtank 100 enter the first reservoir 53 of the ink cartridge 50. As shown in FIGS. 4 and 5, the ink cartridge 50 can be removed from and installed in the subtank 100 in the front-back direction 8.

Layout of Ink Cartridge 50 and Subtank 100

The layout of the ink cartridge 50 and the subtank 100 will now be described. In the layout described below, the ink cartridge 50 is installed in the installation case 71, and the ink cartridge 50 and the subtank 100 are in the use posture shown in FIG. 5.

As shown in FIG. 5, the protrusion 65 of the ink cartridge 50 is located at substantially the same position as the joint 102 in the up-down direction 7, whereas the part of the ink cartridge 50 above the protrusion 65 is located higher than the joint 102. Thus, a most part of the first reservoir 53 of the ink cartridge 50 is located higher than the second opening 132. The upper part of the subtank 100, or the part at and above the curved upper wall 130, is located at substantially the same position as the joint 102, whereas the part of the subtank 100 below the curved upper wall 130 is located lower than the joint 102. Thus, a most part of the second reservoir 105 of the subtank 100 is located lower than the third opening 141.

The part of the first reservoir 53 above the protrusion 65 is located higher than the horizontal part 134 of the liquid flow path 103 and the horizontal part 144 of the gas flow path 104. The second reservoir 105 is located lower than the horizontal part 134 of the liquid flow path 103 and the horizontal part 144 of the gas flow path 104. The lower part of the first reservoir 53 and the upper part of the second reservoir 105 are arranged coaxially in the front-back direction 8. The first reservoir 53 has a larger volume than the second reservoir 105.

The horizontal part 144 of the gas flow path 104 is located higher than the horizontal part 134 of the liquid flow path 103.

As shown in FIG. 7, the first opening 131 of the liquid flow path 103, the third opening 141 of the gas flow path 104, and the air communication port 106 are located rearward in the stated order from the communication port 61 of the first reservoir 53. The position of the communication port 61 of the first reservoir 53 in the up-down direction 7 corresponds to the position in the up-down direction 7 at which the first reservoir 53 and the liquid flow path 103 communicate with each other. The rearward direction from the communication port 61 at this position in the up-down direction 7 is a direction away from the first reservoir 53.

Air Communication Portion 70

As shown in FIGS. 5, 11, 12A, and 12B, the air communication portion 70 includes a buffer tank 90, communication flow paths 145, and an air communication path 147.

Buffer Tank 90

As shown in FIGS. 5 and 11, the buffer tank 90 is located under the installation case 71 and above the subtank 100.

As shown in FIGS. 5 and 11, the buffer tank 90 includes an upper wall 91, a lower wall 92, two side walls 93, three partition walls 94, a rear wall 95, and an upright wall 96. The upper wall 91 extends along a plane inclined with respect to the horizontal plane. The lower wall 92 extends in parallel with the horizontal plane in the rear part and curves upward as it extends forward. The lower wall 92 has a front end connected to the front end of the upper wall 91. The two side walls 93 connect the upper wall 91 and the lower wall 92 in the up-down direction 7 at both ends of the upper and lower walls in the left-right direction 9. The three partition walls 94 are arranged in the left-right direction 9 in parallel with the two side walls 93. The rear wall 95 connects the rear end of the upper wall 91 and the rear end of the lower wall 92. The upright wall 96 extends upward from the rear end of the upper wall 91. The rear wall 95 and the upright wall 96 have a gap between them in the front-back direction 8.

The upper wall 91 of the buffer tank 90 is located below the lower wall 73 of the installation case 71. The upper wall 91 of the buffer tank 90 supports the lower wall 73 of the installation case 71. Thus, the upper wall 91 of the buffer tank 90 can support the ink cartridge 50 housed in the installation case 71 with the lower wall 73 of the installation case 71.

Buffer Chamber 97

The internal space defined by the upper wall 91, the lower wall 92, the two side walls 93, and the rear wall 95 is partitioned by the three partition walls 94 into four buffer chambers 97. The four buffer chambers 97 are each connected to and communicate with the corresponding one of the four subtanks 100. Each of the four buffer chambers 97 is a storage space for air delivered to the first reservoir 53 as the ink in the first reservoir 53 is fed to the second reservoir 105 by gas-liquid displacement. The four buffer chambers 97 are located above the recorder 24.

As shown in FIG. 5, the first reservoir 53 is located above the buffer chamber 97, and the buffer chamber 97 is located above the second reservoir 105. The part of the first reservoir 53 formed in the protrusion 65 and a part of the buffer chamber 97 are arranged coaxially in the front-back direction 8 (an example of the horizontal direction). In addition, a part of the protrusion 65, a part of the joint 102, and a part of the buffer tank 90 are arranged coaxially in the front-back direction 8 (an example of the horizontal direction). Additionally, a part of the first reservoir 53 and a part of the buffer chamber 97 are arranged coaxially in the up-down direction 7.

Communication Flow Path 145

Figure 12A:
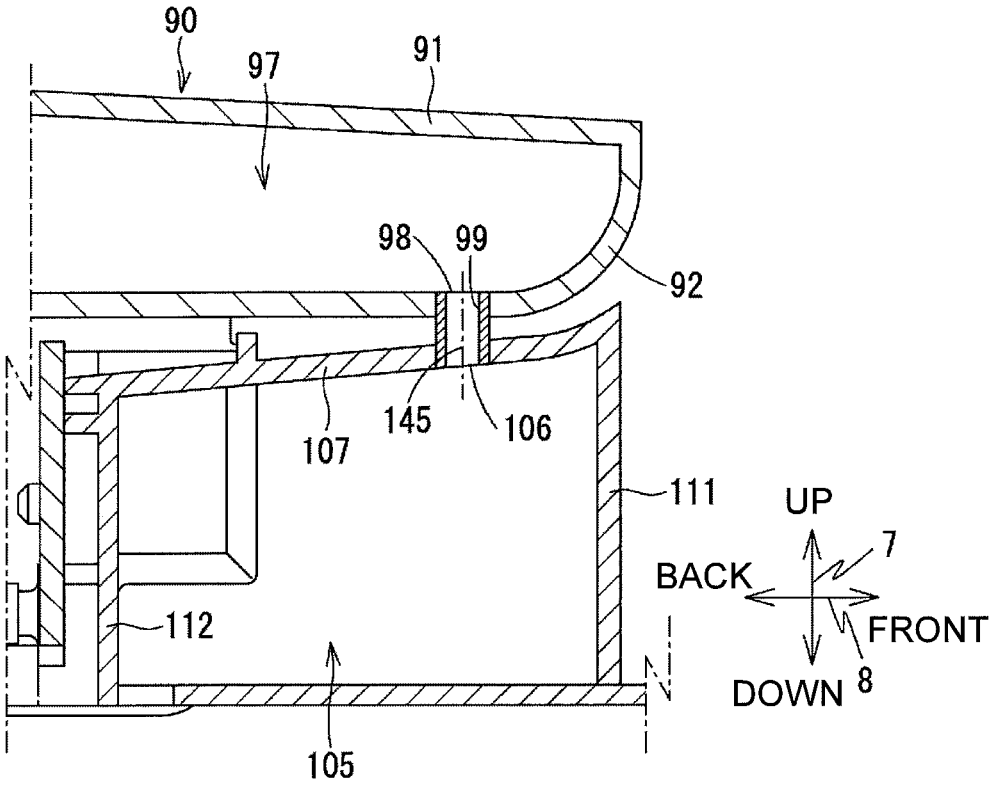
FIG. 12A is a cross-sectional view taken in the arrow direction of line XIIA-XIIA in FIG. 10.

As shown in FIG. 12A, the lower wall 92 of the buffer tank 90 has openings 98 communicating with the buffer chambers 97. The ink feeder 15 includes connection pipes 99 connecting the air communication ports 106 in the tank bodies 101 and the openings 98 in the buffer tank 90. The connection pipes 99 are cylindrical. The inner surface of each connection pipe 99 defines a communication flow path 145 connecting the second reservoir 105 and the buffer chamber 97. The communication flow path 145 extends in the up-down direction 7.

Air Communication Path 147

Figure 12B:
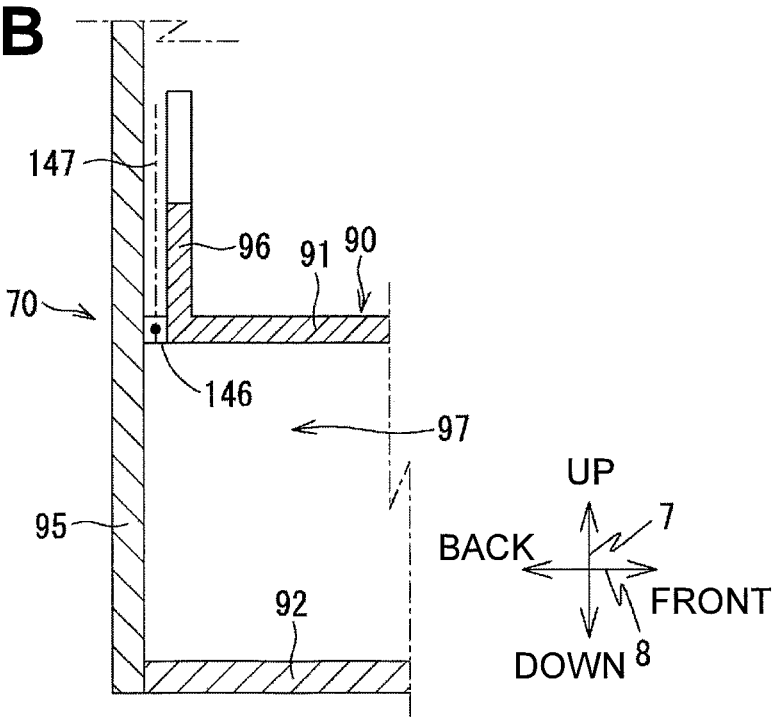
FIG. 12B is a cross-sectional view taken in the arrow direction of line XIIB-XIIB in FIG. 11.

As shown in FIG. 12B, the upper wall 91 has an opening 146 at its rear end in each buffer chamber 97. The upper wall 91 has four openings 146 behind the upright wall 96. The bottom surface of the upper wall 91 is inclined upward in the front-back direction 8 (an example of the horizontal direction) away from the openings 98 (rearward). The openings 146 are formed in the upper wall 91 at the highest position of the bottom surface of the upper wall 91 in the up-down direction 7. The front surface of the rear wall 95 and the rear surface of the upright wall 96 define an air communication path 147 extending in the up-down direction 7. The air communication path 147 extends through the opening 146 upward from the buffer chamber 97, and communicates with the outside of the housing 14 of the multifunction peripheral 10.

Operation in Present Embodiment

The flow of ink and air at the initial loading of an ink cartridge 50 into an empty subtank 100 will now be described.

Before initially loaded (or in an unloaded state) as shown in FIG. 6, the ink cartridge 50 is separate from the subtank 100. In the unloaded state, the communication port 61 of the ink cartridge 50 is closed by the plug 62, and the first reservoir 53 is sealed in the ink cartridge 50. Thus, ink filling the first reservoir 53 does not flow outside. In the unloaded state, the upper opening 125 and the lower opening 126 (see FIG. 7) of the subtank 100 are closed by the plug 120. Thus, the second opening 132 of the liquid flow path 103 and the fourth opening 142 of the gas flow path 104 communicating with the second reservoir 105 are closed to the outside. The second reservoir 105 includes, in addition to the liquid flow path 103 and the gas flow path 104, the air communication port 106 (see FIG. 7) and the communication port 129 (see FIG. 7) for communicating with the outside. The air communication port 106 communicates with the air outside the multifunction peripheral 10 through the buffer chamber 97. The communication port 129 communicates with the printhead 39 through the ink tube 32. However, when the printhead 39 is idle, no ink flows out through the communication port 129. In this state, the second reservoir 105 contains no ink and is empty.

As shown in FIGS. 5 and 7, when the ink cartridge 50 is installed in the subtank 100, the plug 62 closing the communication port 61 moves forward against the urging force of the spring 63, and the plug 120 closing the upper opening 125 and the lower opening 126 moves rearward against the urging force of the spring 121. As a result, the first reservoir 53 communicates with the second reservoir 105 through the liquid flow path 103 and the gas flow path 104. In this state, the ink in the first reservoir 53 of the ink cartridge 50 falls freely through the liquid flow path 103 and enters the second reservoir 105 of the subtank 100. With the air communication port 106 open to the outside air, air with the same volume as the ink entering the second reservoir 105 flows into the first reservoir 53 through the air communication port 106 and the gas flow path 104. In this manner, the ink in the first reservoir 53 is fed to the second reservoir 105 as the ink in the first reservoir 53 is replaced by air (gas-liquid displacement).

As the gas-liquid displacement proceeds, the liquid level of the ink in the second reservoir 105 increases. When the liquid level of the ink increases and reaches the lower end position of the vertical wall 115, the third opening 141 of the gas flow path 104 is closed. In this state, the gas-liquid displacement no longer proceeds, thus stopping the ink feeding from the first reservoir 53 to the second reservoir 105. The ink is fed in this manner at the initial loading.

The flow of ink and air during a recording operation performed by the printer unit 11 with the ink cartridge 50 in the installed state will now be described.

When the printhead 39 discharges ink during the recording operation, the ink in the second reservoir 105 is drawn to the printhead 39 through the communication port 129. The liquid level of the ink in the second reservoir 105 lowers as the ink decreases, thus opening the closed third opening 141 of the gas flow path 104. When the third opening 141 of the gas flow path 104 is open, the gas-liquid displacement is performed in the manner described above to feed ink from the first reservoir 53 to the second reservoir 105. To supplement ink used in the printhead 39, ink is fed from the first reservoir 53 to the second reservoir 105. The liquid level of the ink in the second reservoir 105 remains at the position of the third opening 141 of the gas flow path 104.

When the ink in the first reservoir 53 is used up, the empty ink cartridge 50 can be replaced with another ink cartridge 50 filled with ink to allow the multifunction peripheral 10 to continue the recording operation.

Controller 230

As shown in FIG. 13, the controller 230 includes a central processing unit (CPU) 231, a read-only memory (ROM) 232, a random-access memory (RAM) 233, an electrically programmable read-only memory (EEPROM) 234, and an application-specific integrated circuit (ASIC) 235. The ROM 232 stores various programs to be executed by the CPU 231 to control various operations. The RAM 233 provides a storage area for temporarily storing data or signals used by the CPU 231 executing the programs or a work area used for processing data. The EEPROM 234 stores setting information to be retained after the power is shut off. The ROM 232, the RAM 233, and the EEPROM 234 are examples of a device memory.

The ASIC 235 is used to operate the feed roller 25, the conveyance roller 34, the discharge roller 36, and the printhead 39. The controller 230 rotates the feed roller 25, the conveyance roller 34, and the discharge roller 36 by driving a motor (not shown) through the ASIC 235. The controller 230 further outputs a driving signal to a driving element of the printhead 39 through the ASIC 235 to cause the printhead 39 to discharge ink through the nozzles 40. The ASIC 235 can output different driving signals depending on the amount of ink to be discharged through the nozzles 40.

The display 17 and the operation panel 22 are connected to the ASIC 235.

The contact 152, the cover sensor 88, the installation sensor 154, and the liquid level sensor 155 are also electrically connected to the ASIC 235. The controller 230 accesses the memory of the IC chip 66 of the ink cartridge 50 installed in the installation case 71 through the contact 152. The controller 230 detects the position of the cover 48 with the cover sensor 88. The controller 230 also detects the ink cartridge 50 installed in the installation case 71 based on a detection signal from the installation sensor 154. The controller 230 further detects the liquid level of the ink stored in the second reservoir 105 equal to or higher than the predetermined level B with the liquid level sensor 155.

When the liquid level sensor 155 outputs a high-level signal, the ROM 232 stores a predetermined ink amount Vsc (an example of a fixed value A) stored in the second reservoir 105 of the subtank 100 and a predetermined ink amount Vcc stored in the first reservoir 53 of the ink cartridge 50. The predetermined ink amount Vcc is zero in the present embodiment.

The EEPROM 234 stores various items of information associated with the four ink cartridges 50 installed in the installation case 71, in other words, associated with the subtanks 100 communicating with the ink cartridges 50. The various items of information include, for example, ink amounts Vc and Vs, which are examples of the liquid amount, a volume $V_{th}$, a flag C_Empty, a flag S_Empty, a count value SN, a count value TN, and a threshold value $N_{th}$.

The ink amount Vc and the identification information are read by the controller 230 from the memory of the IC chip 66 through the contact 152 while the ink cartridge 50 is installed in the installation case 71. The volume $V_{th}$ may be stored in the ROM 232 instead of the EEPROM 234.

The ink amount Vc indicates the amount of ink stored in the first reservoir 53 of the ink cartridge 50. The ink amount Vs indicates the amount of ink stored in the second reservoir 105 of the subtank 100. The ink amounts Vc and Vs are calculated based on, for example, the volume $V_{th}$. When the first reservoir 53 of the ink cartridge 50 contains ink that can flow into the subtank 100, the liquid level of the ink in the second reservoir 105 of the subtank 100 is at the position of the imaginary line L including the third opening 141 of the gas flow path 104. This state is referred to as the equilibrium state. More specifically, in the equilibrium state, ink transfer stops between the first reservoir 53 and the second reservoir 105. The ink amount Vs in the equilibrium state is the volume $V_{th}$ of the second reservoir 105 lower than the imaginary line L. Thus, once the total amount Vt of ink is calculated, the ink amount Vs and the ink amount Vc can be calculated. More specifically, when the total amount Vt is equal to or greater than the volume $V_{th}$, the ink amount Vs is the volume Vth, and the ink amount Vc is obtained by subtracting the volume $V_{th}$ from the total amount Vt. When the total amount Vt is smaller than the volume Vth, the ink amount Vs is equal to the total amount Vt, and the ink amount Vc is zero. The ink amounts Vc and Vs may be determined by referring to a table storing the correspondence between the ink amounts and the total amount Vt without using the volume Vth.

The count value SN is equivalent to an ink discharge amount Dh (an ink amount indicated by a driving signal) instructed to discharge through the printhead 39 after the signal output from the liquid level sensor 155 changes from a low level to a high level and is updated toward the threshold value $N_{th}$. The count value SN is counted up from an initial value of 0. The threshold value $N_{th}$ is equivalent to the volume of a part of the second reservoir 105 between the position near the upper end of the communication port 129 and the predetermined level B. However, the count value SN may be counted down from an initial value equivalent to the volume. In this case, the threshold value $N_{th}$ is zero (0). The count value SN is an example of a second count value.

The count value TN is equivalent to an ink discharge amount Dh (an ink amount indicated by a driving signal) instructed to discharge through the printhead 39 after the signal output from the cover sensor 88 changes from a high level to a low level, and is counted up from an initial value of 0. The count value TN may be counted down from an initial value equivalent to the total amount Vt of ink. The count value TN is an example of a first count value as well.

The flag C_Empty is information indicating whether the ink cartridge 50 is in a cartridge empty state. The flag C_Empty is set either ON corresponding to the cartridge empty state or OFF corresponding to a non-cartridge empty state. The cartridge empty state refers to the state of the ink cartridge 50 (more specifically, the first reservoir 53) storing substantially no ink. In other words, the cartridge empty state refers to the state of no ink transferred from the first reservoir 53 to the second reservoir 105 communicating with each other. More specifically, the cartridge empty state refers to the state in which the liquid level of the subtank 100 communicating with the ink cartridge 50 is lower than the predetermined level B.

The flag S_Empty is information indicating whether the subtank 100 is in the empty ink state. The flag S_Empty is set either ON corresponding to the empty ink state or OFF corresponding to a non-empty ink state. The empty ink state refers to, for example, the state of the liquid level of the ink stored in the subtank 100 (more specifically, the second reservoir 105) reaching the position near the upper end of the communication port 129. In other words, the empty ink state refers to the state of the count value SN1 equal to or greater than the threshold value Nthl. When the ink continues to be discharged through the printhead 39 in the empty ink state, the liquid level of the ink in the subtank 100 may fall below the upper end of the communication port 129, and air may mix in an ink flow path from the subtank 100 to the printhead 39 or in the printhead 39 (air entrapment). The nozzles 40 may not be filled with the ink, and the ink may not be discharged.

Operation of Multifunction Peripheral 10

Figure 15:
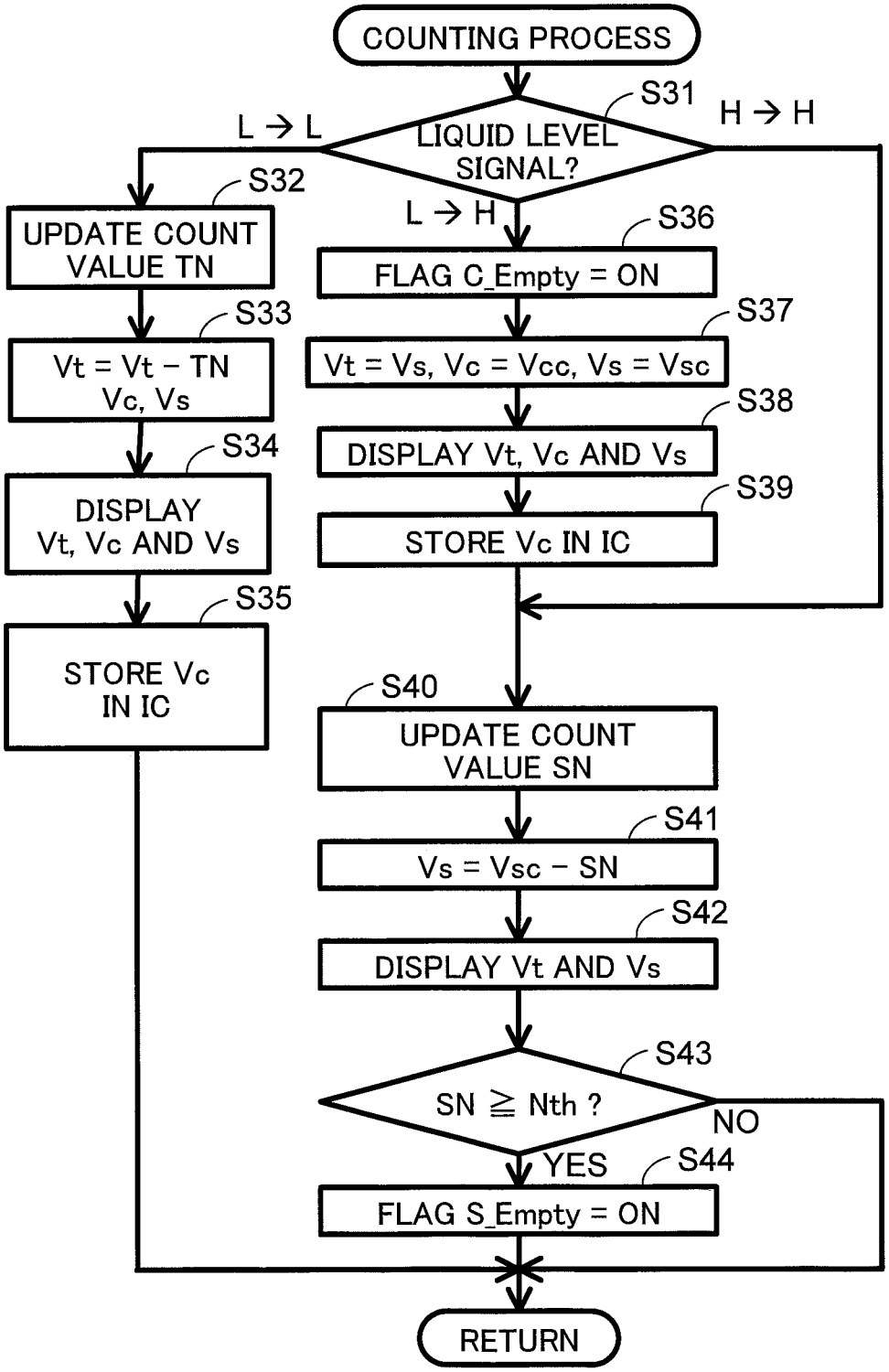
FIG. 15 is a flowchart of a counting process.

The operation of the multifunction peripheral 10 according to the present embodiment will be described with reference to FIGS. 14 and 15. Each of the processes shown in FIGS. 14 and 15 is performed by the CPU 231 of the controller 230. Each of the processes described below may be performed by the CPU 231 reading programs stored in the ROM 232, or may be implemented by a hardware circuit installed in the controller 230. Further, the processes described below can be performed in an order changed appropriately without departing from the spirit and scope of the present disclosure.

Image Recording Process

The controller 230 performs an image recording process shown in FIG. 14 in response to a recording instruction input to the multifunction peripheral 10. The recording instruction is an example of first and second discharge instructions for causing the multifunction peripheral 10 to record an image represented by image data on a sheet. The recording instruction may be received in any manner, but may be received as a corresponding user operation performed through the operation panel 22 or may be received from an external device through a communication interface (not shown).

First, the controller 230 determines the set values for the four flags S_Empty (S11). When determining that at least one of the four flags S_Empty is set ON (S11: ON), the controller 230 displays a notification screen S_Empty on the display 17 (S12). The notification screen S_Empty notifies the user that the corresponding subtank 100 is in the empty ink state and the ink cannot be discharged through the printhead 39. For example, the notification screen S_Empty may include information indicating the color and the ink amounts Vc and Vs of the ink stored in the subtank 100 in the empty ink state. In step S12, the controller 230 may display the notification screen C_Empty on the display 17 together with the notification screen S_Empty when determining that at least one of the four flags C_Empty is set ON.

The controller 230 also performs the processing in steps S13 to S19 for each ink cartridge 50 corresponding to the flag S_Empty set ON. More specifically, the processing in steps S13 to S19 is performed for each ink cartridge 50 for which the flag S_Empty is set ON, among the four ink cartridges 50. The processing in steps S13 to S19 is common to the ink cartridges 50. The processing in steps S13 to S19 for one ink cartridge 50 will be described.

The controller 230 first obtains a signal output from the installation sensor 154 (S13). The controller 230 then determines whether the signal obtained from the installation sensor 154 is a high-level signal or a low-level signal (S14). Then, the controller 230 repeatedly performs the processing in steps S13 and S14 at predetermined time intervals until the signal output from the installation sensor 154 changes from a low level to a high level and then from a high level to a low level again (S14: No). In other words, the controller 230 repeatedly performs the processing in steps S13 and S14 until the ink cartridge 50 is removed from the installation case 71 and an ink cartridge 50 is newly installed in the installation case 71.

In response to a low-level signal, a high-level signal, and then a low-level signal obtained in the stated order from the installation sensor 154 (S14: Yes), the controller 230 performs the processing in step S15. More specifically, the controller 230 reads identification information and an ink amount Vc from the IC chip 66 of the ink cartridge 50 through the contact 152, and stores the identification information and the ink amount Vc into the EEPROM 234 (S15). At this time, the controller 230 updates the ink amount Vc stored in the EEPROM 234 to the ink amount Vc read from the IC chip 66.

The controller 230 also calculates the total amount Vt after the cartridge replacement (S16). In detail, the controller 230 calculates the ink amount Vs before the cartridge replacement based on the count value SN before the cartridge replacement stored in the EEPROM 234 and the ink amount Vsc stored in the ROM 232 (Vs=Vsc−SN), and stores the ink amount Vs into the EEPROM 234. The ink amount Vs before the cartridge replacement is equal to the total amount Vt before the cartridge replacement. Based on the calculated ink amount Vs and the ink amount Vc read from the memory of the IC chip 66 of the replaced ink cartridge 50, the total amount Vt after the cartridge replacement is calculated. More specifically, once the ink cartridge 50 is replaced, the ink amount Vc stored in the first reservoir 53 of the newly installed ink cartridge 50 is added to the ink amount Vs (=Vsc−SN) stored in the second reservoir 105 of the subtank 100 immediately before the ink cartridge 50 is replaced. The controller 230 thus calculates the sum of the ink amount Vc read from the IC chip 66 of the replaced ink cartridge 50 and the ink amount Vs before the cartridge replacement stored in the EEPROM 234 as the total amount Vt (Vt=Vs+Vc).

The controller 230 calculates the ink amount Vc and the ink amount Vs when the liquid level of the ink in the second reservoir 105 reaches the imaginary line L based on the calculated total amount Vt and the volume $V_{th}$ read from the EEPROM 234 (S16). When the ink cartridge is replaced, the ink stored in the first reservoir 53 of the newly installed ink cartridge 50 flows into the second reservoir 105 of the subtank 100 through the liquid flow path 103. As a result, the ink amount Vc of the first reservoir 53 decreases, and the ink amount Vs of the second reservoir 105 increases. The liquid level of the ink in the second reservoir 105 of the subtank 100 then reaches the imaginary line L, and the equilibrium state is entered.

The controller 230 determines whether the calculated total amount Vt is equal to or greater than the volume $V_{th}$. For example, when a fresh ink cartridge 50 is installed in the installation case 71, the total amount Vt is equal to or greater than the volume $V_{th}$. For the total amount Vt equal to or greater than the volume $V_{th}$, the controller 230 determines the volume $V_{th}$ to be the ink amount Vs. Then, the controller 230 stores the calculated ink amount Vc into the EEPROM 234 (S17). At this time, the controller 230 updates the ink amount Vs stored in the EEPROM 234 to the determined ink amount Vs. The controller 230 also stores the calculated ink amount Vc into the memory of the IC chip 66 through the contact 152 (S17). At this time, the controller 230 updates the ink amount Vc stored in the memory of the IC chip 66 to the calculated ink amount Vc.

The controller 230 then determines whether the signal received from the liquid level sensor 155 has changed from a high level to a low level (S18). When an ink cartridge 50 is newly installed in the installation case 71, ink flows from the first reservoir 53 of the ink cartridge 50 into the second reservoir 105 of the subtank 100. When the liquid level of the ink in the second reservoir 105 reaches the predetermined level B, the signal output from the liquid level sensor 155 changes from a high-level signal to a low-level signal. When the signal received from the liquid level sensor 155 remains at a high level (S18: No), the controller 230 repeats the determination in step S18 until receiving a low-level signal. More specifically, the controller 230 waits until the liquid level of the ink in the second reservoir 105 is raised to the predetermined level B.

When determining that the signal received from the liquid level sensor 155 has changed from a high level to a low level (S18: Yes), the controller 230 sets each of the flag S_Empty and the flag C_Empty OFF. The controller 230 also deletes either the notification screen S_Empty or the notification screen C_Empty appearing on the display 17 (S19). Further, the controller 230 displays the calculated ink amounts Vc and Vs on the display 17. The controller 230 may display the calculated total amount Vt on the display 17. The total amount Vt and the ink amounts Vc and Vs may be numerically indicated, or may be indicated using an image, such as an index bar. Not both the ink amount Vc and the ink amount Vs may be indicated, and at least one of the ink amounts, or for example, the ink amount Vc alone, may be indicated. The controller 230 then performs the processing in step S11 and subsequent steps again.

When the flags S_Empty corresponding to all the ink cartridges 50 are all not ON, or in other words, are all OFF, the controller 230 obtains signals output from the four liquid level sensors 155 at the current time (S20). In step S20, the controller 230 further causes the RAM 233 to store information indicating whether the signal obtained from each liquid level sensor 155 is a high-level signal or a low-level signal.

The controller 230 then records the image represented by the image data included in the recording instruction on one sheet (S21). More specifically, the controller 230 causes the sheet on the feed tray 20 to be conveyed by the feed roller 25 and the conveyance roller 34, the printhead 39 to discharge the ink, and the sheet having the recorded image to be discharged to the discharge tray 21 with the discharge roller 36. More specifically, the controller 230 enables the ink discharge through the printhead 39 when all the four flags S_Empty are set OFF. In contrast, the controller 230 disables the ink discharge through the printhead 39 when at least one of the four flags S_Empty is set ON.

The controller 230 then obtains signals output from the four liquid level sensors 155 at the current time upon recording the image on one sheet in response to the recording instruction (S22). Similarly to step S20, the controller 230 causes the RAM 233 to store information indicating whether the signal obtained from each liquid level sensor 155 is a high-level signal or a low-level signal (S22). The controller 230 then performs a counting process (S23). The counting process is to update the count values TN, SN, the flag C_Empty, and the flag S_Empty based on the signals obtained from each liquid level sensor 155 in steps S20 and S22. The counting process will be described in detail below with reference to FIG. 8.

The controller 230 then repeatedly performs the processing in steps S11 to S24 until all the images indicated by the recording instruction are recorded on one sheet (S24: Yes). After recording all the images indicated by the recording instruction on one sheet (S24: No), the controller 230 determines the set values for the four flags S_Empty and the set values for the four flags C_Empty (S25 and S26).

When at least one of the four flags S_Empty is set ON (S25: ON), the controller 230 displays the notification screen S_Empty on the display 17 (S27). When all the four flags S_Empty are set OFF and at least one of the four flags C_Empty is set ON (S25: OFF and S26: ON), the controller 230 displays the notification screen C_Empty on the display 17 (S28). The processing in steps S25 and S26 is an example of activating the alarm.

The notification screen S_Empty displayed in step S27 may be the same as in step S12. The notification screen C_Empty notifies the user that the ink cartridge 50 corresponding to the flag C_Empty set ON is in the cartridge empty state. For example, the notification screen C_Empty may include information indicating the color and the ink amounts Vc and Vs of the ink stored in the ink cartridge 50 in the cartridge empty state. In contrast, when all the four flags S_Empty and the four flags C_Empty are set OFF (S26: OFF), the controller 230 completes the image recording process.

An example of the discharge instruction is not limited to the recording instruction, but may be a maintenance instruction instructing maintenance of the nozzles 40 such as a purge. For example, the controller 230 performs the same process as in FIG. 14 in response to a maintenance instruction obtained through the operation panel 22. The process in response to a maintenance instruction differs from the above process in the manner described below. First, the controller 230 drives a maintenance mechanism (not shown) in step S21, and discharges the ink through the nozzles 40. The controller 230 also performs the processing in steps subsequent to step S24 without performing the processing in step S24 after the counting process.

Counting Process

The counting process performed by the controller 230 in step S23 will be described in detail with reference to FIG. 15. The controller 230 performs the counting process independently for each of the four ink cartridges 50. The counting process is common to the ink cartridges 50. The counting process for one ink cartridge 50 will be described.

First, the controller 230 compares sets of information indicating the signals from the liquid level sensors 155 stored in the RAM 233 in steps S20 and S22 (S31). More specifically, the controller 230 determines whether the signal from each of the four liquid level sensors 155 has changed before and after the processing in step S21 immediately before the counting process (S23).

When the sets of information stored in the RAM 233 in steps S20 and S22 both indicate a low-level signal (S31: L→L) (in other words, the output of each liquid level sensor 155 remains unchanged before and after the processing in step S21), the controller 230 updates the count value TN (S32). More specifically, the controller 230 counts up the count value TN to a value equivalent to the amount of ink instructed to discharge in the immediately preceding step S21.

The controller 230 also calculates the current total amount Vt (S33). First, the controller 230 calculates the total amount Vt after the cartridge replacement that is the sum of the ink amount Vc and the ink amount Vs stored in the EEPROM 234 after the cartridge replacement. The controller 230 then calculates the current total amount Vt by subtracting the ink amount equivalent to the count value TN from the calculated total amount Vt (Vt=Vt−TN). The controller 230 then obtains the ink amounts Vc and Vs based on the calculated current total amount Vt and the volume $V_{th}$ (S33).

The controller 230 determines whether the calculated current total amount Vt is equal to or greater than the volume $V_{th}$. For the current total amount Vt equal to or greater than the volume $V_{th}$, the controller 230 determines the volume $V_{th}$ to be the ink amount Vs. For the current total amount Vt smaller than the volume $V_{th}$, the controller 230 determines the current total amount Vt to be the ink amount Vs.

Subsequently, the controller 230 displays the calculated ink amounts Vc and Vs and/or the calculated total amount Vt on the display 17 (S34). The controller 230 also updates the ink amount Vc stored in the memory of the IC chip 66 of the ink cartridge 50 to the calculated ink amount Vc (S35).

Figure 16:
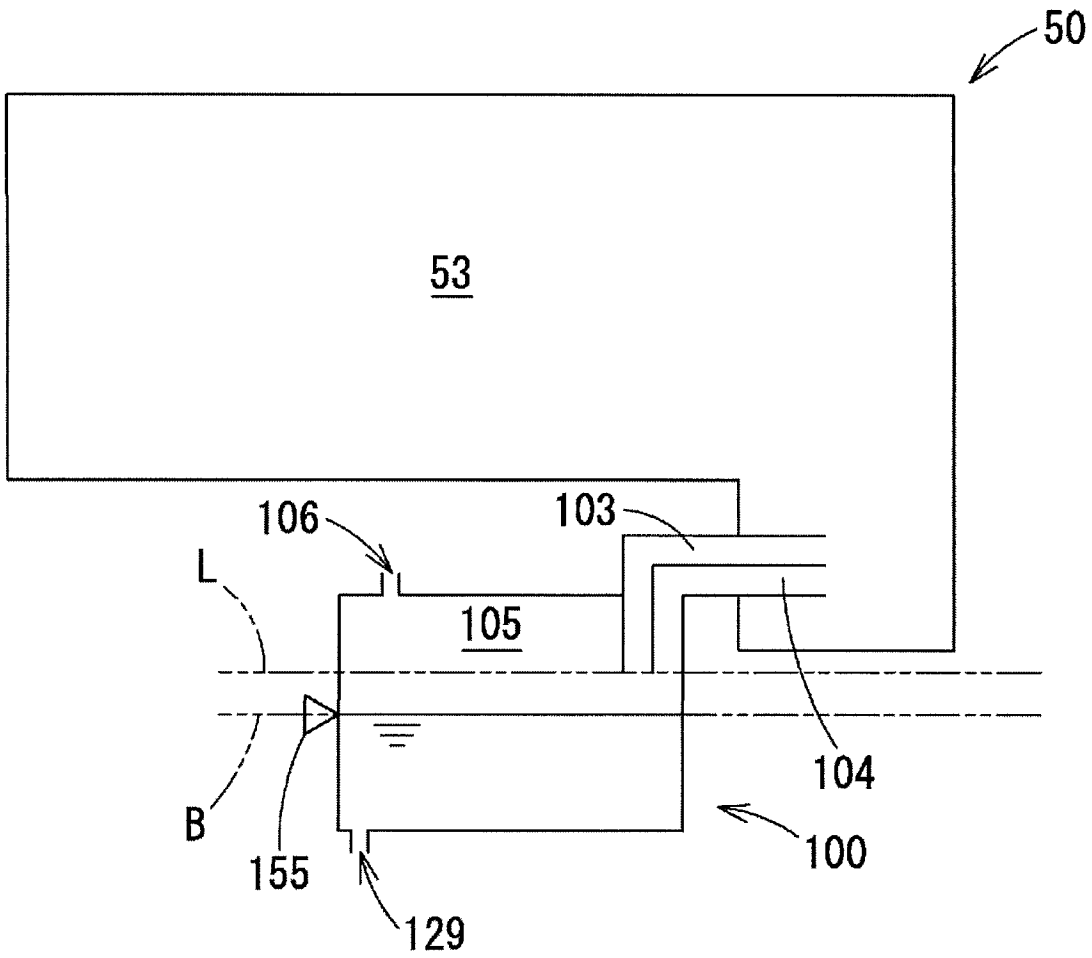
FIG. 16 is a schematic diagram of the ink cartridge 50 and the subtank 100 communicating with each other in which the cartridge is empty.

When the information stored in the RAM 233 in step S20 indicates a low-level signal and the information stored in the RAM 233 in step S22 indicates a high-level signal (S31: L→H) (in other words, the output of the liquid level sensor 155 is changed before and after the processing in step S21), the controller 230 substitutes a value indicating ON into the flag C_Empty (S36). The output from the liquid level sensors 155 changing from a low-level signal to a high-level signal corresponds to the liquid level of the second reservoir 105 reaching the predetermined level B during the processing in step S21 as shown in FIG. 16. Subsequently, no ink transfer occurs between the ink cartridge 50 and the subtank 100.

The controller 230 also reads a predetermined ink amount Vcc (=0) from the ROM 232, and sets the ink amount Vc to the predetermined ink amount Vcc (S37). Similarly, the controller 230 reads a predetermined ink amount Vsc (equivalent to the volume of a part of the second reservoir 105 lower than the predetermined level B) from the ROM 232, and sets the ink amount Vs to the predetermined ink amount Vsc (S37). The ink amounts Vc and Vs calculated in the residual amount updating process include errors. The controller 230 thus sets the ink amount Vc to the predetermined ink amount Vcc and the ink amount Vs to the predetermined ink amount Vsc at the time when the output from the liquid level sensor 155 changes from a low-level signal to a high-level signal, thus resetting the accumulated errors. Further, the controller 230 calculates the current total amount Vt as a value equal to the ink amount Vs (Vt=Vsc) (S37). When the ink amount Vc is zero, the total amount Vt has the same value as the ink amount Vs.

The controller 230 then displays the current ink amounts Vc and Vs and/or the current total amount Vt on the display 17. The controller 230 also overwrites the ink amount Vc stored in the memory of the IC chip 66 of the ink cartridge 50 with the above ink amount Vc (=0) (S39). Information indicating the ink amount Vc=0 stored in the memory of the IC chip 66 is an example of ink runout information.

The output of each liquid level sensor 155 changes during the processing in step S21. The predetermined ink amount Vsc read in step S37 is thus not strictly the amount of ink stored in the subtank 100 at the moment when the output from the liquid level sensor 155 changes, but indicates the amount of ink immediately before the output from the liquid level sensor 155 changes. With the difference between the ink amounts being small, the predetermined ink amount Vsc read in step S37 is approximately the ink amount Vs at the time when the output from the liquid level sensor 155 changes.

The controller 230 also counts up the count value SN stored in EEPROM 234 to the value equivalent to the amount of ink instructed to discharge in the immediately preceding step S21 (S40). In other words, the controller 230 starts updating the count value SN in response to the output from the liquid level sensors 155 changing from a low-level signal to a high-level signal. The controller 230 counts up the count value TN stored in the EEPROM 234 to a value equivalent to the amount of ink instructed to discharge in the immediately preceding step S21.

The controller 230 then calculates the ink amount Vs (S41). The calculated ink amount Vs is obtained by subtracting the ink amount equivalent to the count value SN stored in the EEPROM 234 from the predetermined ink amount Vsc stored in the ROM 232. As described above, after the output from the liquid level sensor 155 changes to a high-level signal, the ink amount Vs is the same value as the current total amount Vt. The ink amount Vc is zero.

The controller 230 then displays the calculated current ink amounts Vc and Vs and/or the calculated current total amount Vt on the display 17 (S42). The ink amount Vc is zero after the output from the liquid level sensor 155 changes to a high-level signal, and thus the controller 230 does not update the ink amount Vc stored in the memory of the IC chip 66 of the ink cartridge 50.

The controller 230 then compares the count value SN updated in step S40 with the threshold value $N_{th}$ (S43). When determining that the count value SN updated in step S40 is smaller than the threshold value $N_{th}$ (S43: No), the controller 230 completes the counting process. In contrast, when determining that the count value SN updated in step S40 is equal to or greater than the threshold value Nth (S43: Yes), the controller 230 substitutes the value indicating ON into the flag S_Empty (S44). The controller 230 disables the ink discharge through the printhead 39 in response to the flag S_Empty set ON, and completes the counting process.

When the sets of information stored in the RAM 233 in steps S20 and S22 both indicate a high-level signal (S31: H→H), the controller 230 reads the count value SN stored in the EEPROM 234. The controller 230 then counts up the read count value SN to a value equivalent to the amount of ink instructed to discharge in the immediately preceding step S21 and stores the value into the EEPROM 234 again. More specifically, the controller 230 updates the count value SN (S40). The controller 230 also updates the count value TN. The controller 230 then performs the processing from steps S41 to S44 described above using the count value SN updated in step S40.

Operational Effects of First Embodiment

The structure according to the first embodiment can obtain the ink amounts Vc and Vs from the current total amount Vt using the volume $V_{th}$. Further, the total amount Vt is updated to the predetermined ink amount Vsc in response to a high-level signal output from the liquid level sensor 155, and the total amount Vt can be corrected. The ink amounts Vc and Vs can then be determined from the corrected total amount Vt. The time at which ink is no longer fed from the first reservoir 53 of the ink cartridge 50 to the second reservoir 105 of the subtank 100 as well as the subsequent ink amount Vs can also be determined. The value updated to the predetermined ink amount Vsc may not be the total amount Vt but may be the ink amount Vs. When the liquid level sensor 155 outputs a high-level signal, ink is not transferred from the first reservoir 53 to the second reservoir 105, and the total amount Vt is equal to the ink amount Vs.

The controller 230 displays, on the display 17, the notification screen C_Empty with a message urging replacement of the ink cartridge to notify the user that the ink cartridge 50 is to be replaced.

With the ink amount Vc stored in the memory of the IC chip 66, the ink amount Vc of the first reservoir 53 in the ink cartridge 50 can be read from the IC chip 66 after the ink in the ink cartridge 50 has been used and the ink cartridge 50 is removed from the installation case 71. When the ink cartridge 50 in which the ink has run out is installed in the installation case 71, the ink amount Vc is read from the IC chip 66, and the total amount Vt is calculated.

With the memory of the IC chip 66 storing ink amount Vc=0, the ink cartridge 50 can be determined to contain no ink.

Second Embodiment

Figure 17:
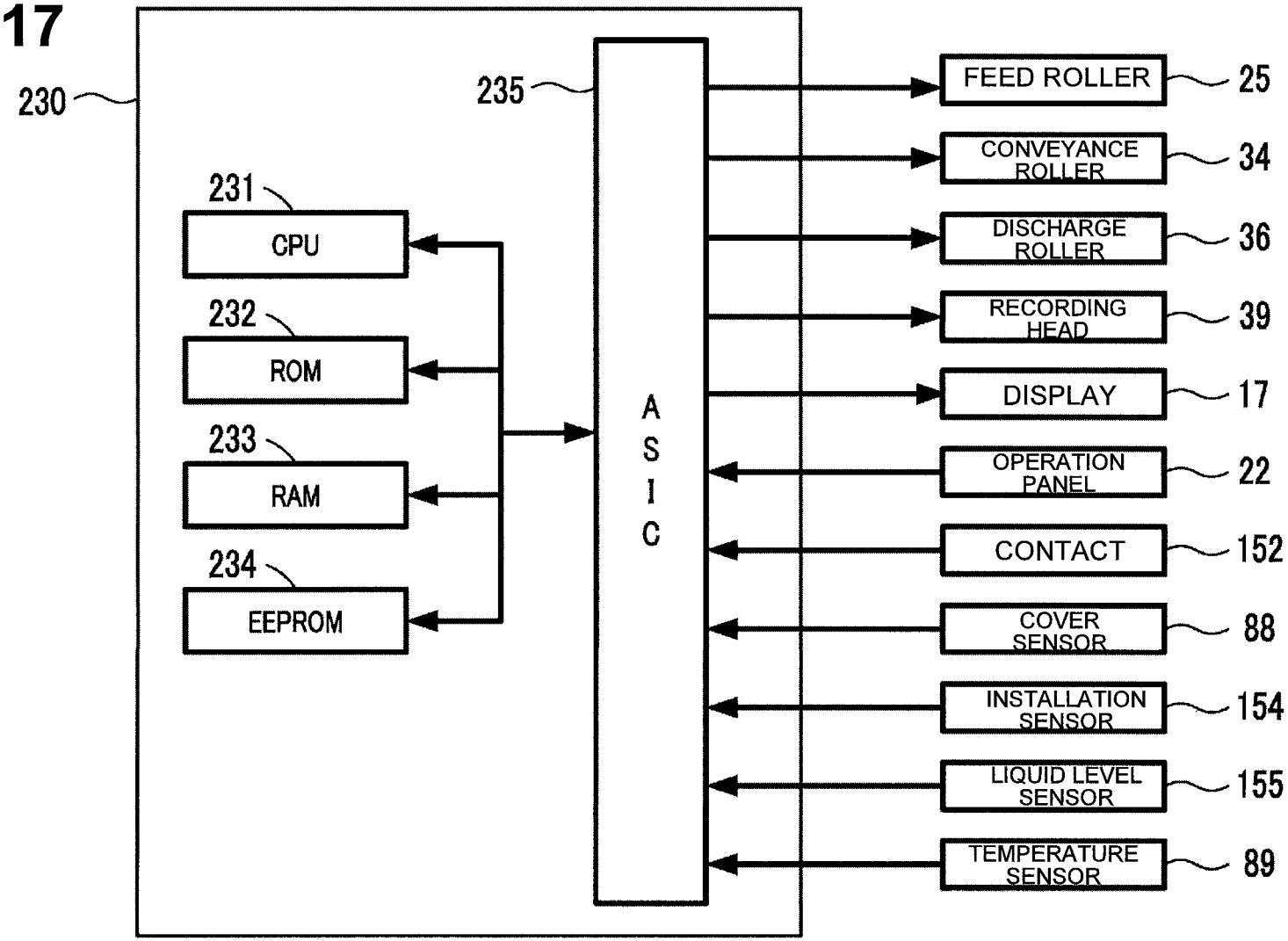
FIG. 17 is a block diagram of a multifunction peripheral 10 according to a second embodiment.

A second embodiment will now be described. The structure of a multifunction peripheral 10 according to the second embodiment is the same as in the first embodiment except that the multifunction peripheral 10 includes a temperature sensor 89 and the controller 230 receives a signal output from the temperature sensor 89 as shown in FIG. 17, and will not be described in detail. The operation of the multifunction peripheral 10 according to the second embodiment will now be described.

Image Recording Process

Figure 18B:
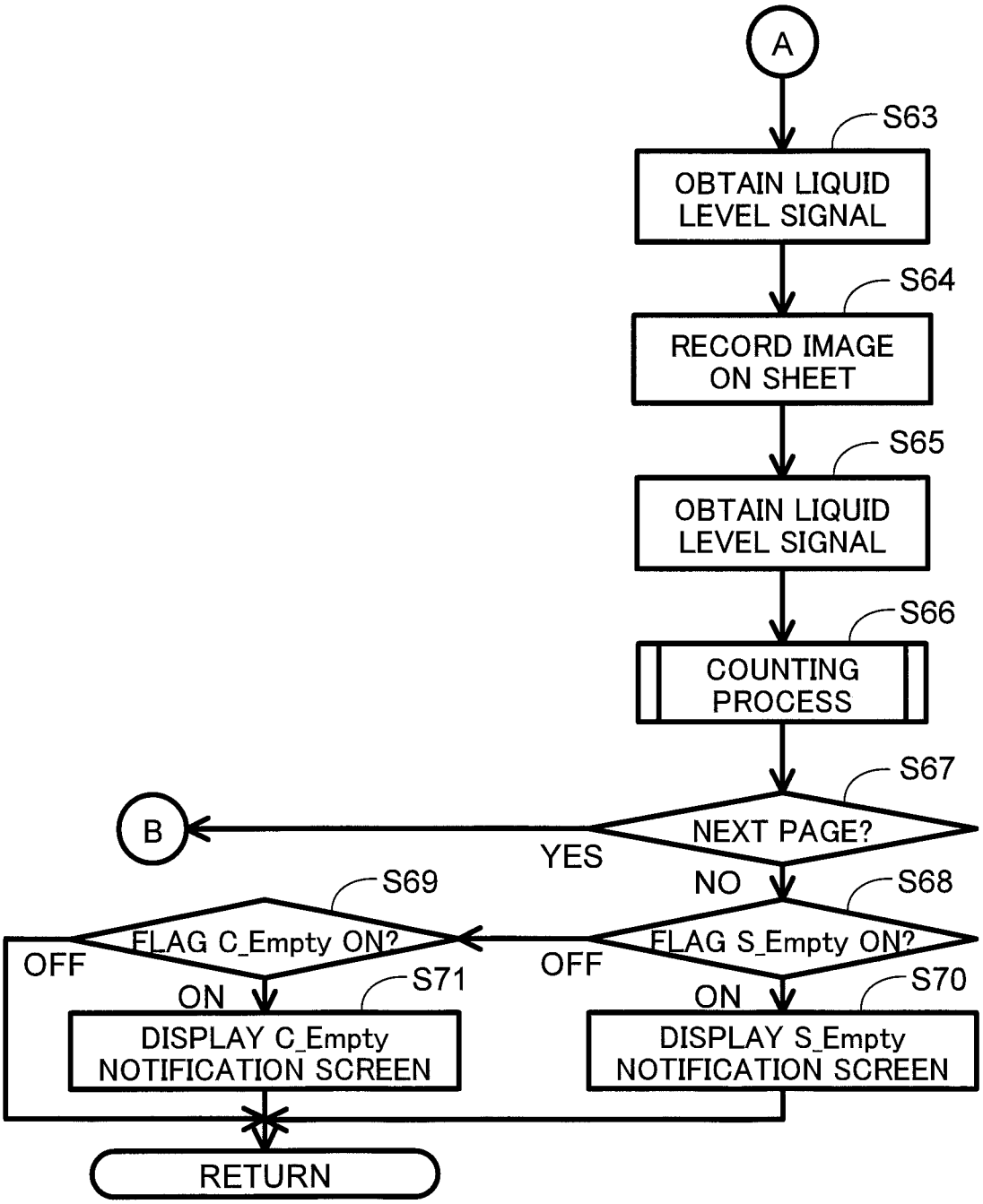

The controller 230 performs an image recording process shown in FIGS. 18A and 18B in response to a recording instruction input to the multifunction peripheral 10. The recording instruction is an example of a discharge instruction for causing the multifunction peripheral 10 to record an image represented by image data on a sheet. The recording instruction may be received in any manner, but may be received as a corresponding user operation performed through the operation panel 22 or may be received from an external device through a communication interface (not shown).

First, the controller 230 determines the set values of the flags S_Empty for the four ink cartridges 50 (S51). When determining that at least one of the flags S_Empty for the four ink cartridges 50 is set ON (S51: ON), the controller 230 displays a notification screen S_Empty on the display 17 (S52). The notification screen S_Empty notifies the user that the corresponding subtank 100 is in the empty ink state and the ink cannot be discharged through the printhead 39. For example, the notification screen S_Empty may include information indicating the color and the ink amounts Vc and Vs of the ink stored in the subtank 100 in the empty ink state. In step S52, the controller 230 may display the notification screen C_Empty on the display 17 together with the notification screen S_Empty when determining that at least one of the flags C_Empty for the four ink cartridges 50 is set ON. The notification screen S_Empty appearing on the display 17 in step S52 is an example of activating a first notification of the alarm.

Figure 20A:
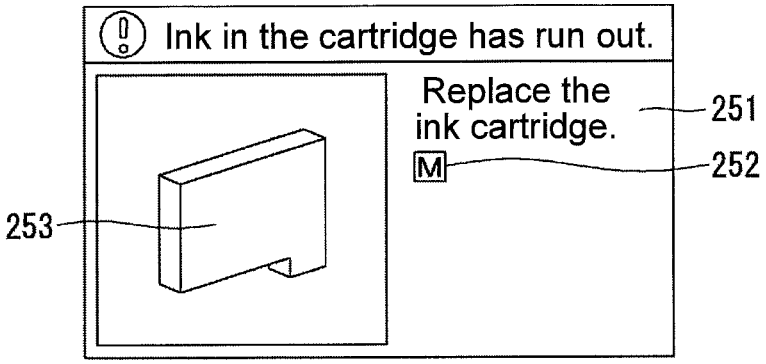
FIG. 20A is a diagram showing a notification screen S_Empty.

FIG. 20A is a diagram displaying an example notification screen S_Empty. The example notification screen S_Empty includes objects 251, 252, and 253. The object 251 is a message urging replacement of the ink cartridge 50 and carries a text message: Replace the ink cartridge. The object 252 indicates the type of the ink cartridge 50 to be replaced. In the illustrated example, the object 252 includes letter M representing magenta. The object 253 represents an empty ink cartridge 50.

The controller 230 also performs the processing in steps S53 to S62 for each ink cartridge 50 corresponding to the flag S_Empty set ON. More specifically, the processing in steps S53 to S62 is performed for each ink cartridge 50 for which the flag S_Empty is set ON, among the four ink cartridges 50. The processing in steps S53 to S62 is common to the ink cartridges 50. The processing in steps S53 to S62 for one ink cartridge 50 will be described.

The controller 230 first receives a signal output from the installation sensor 154 (S53). The controller 230 then determines whether the signal received from the installation sensor 154 has changed from a high-level signal to a low-level signal (S54). Then, the controller 230 repeatedly performs the processing in steps S53 and S54 at predetermined time intervals until the signal output from the installation sensor 154 changes from a low level to a high level and then from a high level to a low level again (S54: No). In other words, the controller 230 repeatedly performs the processing in steps S53 and S54 until the ink cartridge 50 is removed from the installation case 71 and an ink cartridge 50 is newly installed in the installation case 71.

In response to a low-level signal, a high-level signal, and then a low-level signal received in the stated order from the installation sensor 154 (S54: Yes), the controller 230 reads the identification information, type information, and the ink amount Vc from the IC chip 66 of the ink cartridge 50 through the contact 152, and stores the items of information into the EEPROM 234 (S55). At this time, the controller 230 updates the ink amount Vc stored in the EEPROM 234 to the ink amount Vc read from the IC chip 66.

The controller 230 then deletes the notification screen S_Empty from the display 17 and displays an ink in-flow screen on the display 17 (S56). The ink in-flow screen notifies the user that ink is flowing from the ink cartridge 50 into the subtank 100. The ink in-flow screen appearing on the display 17 is an example of activating a third notification of the alarm.

Figure 20B:
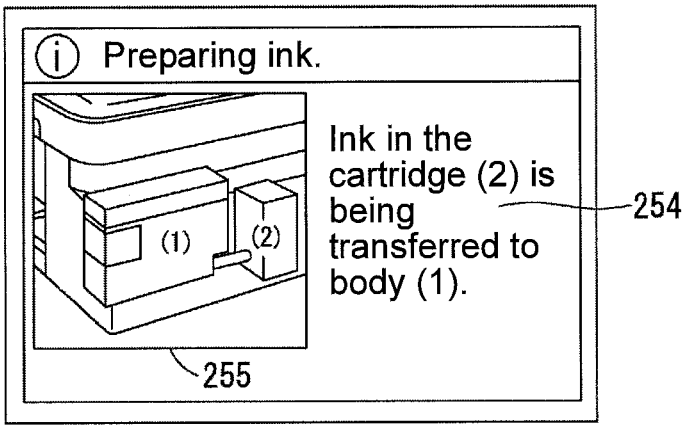
FIG. 20B is a diagram showing an ink in-flow screen.

FIG. 20B is a diagram showing an example ink in-flow screen. In the illustrate example, the ink in-flow screen includes objects 254 and 255. The object 254 indicates that ink is flowing from the ink cartridge 50 into the subtank 100 and carries a text message: Ink in cartridge (1) is being transferred to body (2). The object 255 represents the ink cartridge 50 and the subtank 100 in the multifunction peripheral 10 in a schematic view.

The controller 230 then determines that the signal received from the liquid level sensor 155 has changed from a high-level signal to a low-level signal (S57). When an ink cartridge 50 is newly installed in the installation case 71, ink flows from the first reservoir 53 of the ink cartridge 50 into the second reservoir 105 of the subtank 100. When the liquid level of the ink in the second reservoir 105 reaches the predetermined level B, the signal output from the liquid level sensor 155 changes from a high-level signal to a low-level signal. When the signal received from the liquid level sensor 155 remains at a high level (S57: No), the controller 230 performs a determination process for an elapsed time T (S58).

The controller 230 selects and reads a predetermined time ST from the ROM 232 based on the type information read from the IC chip 66 of the ink cartridge 50 in step S55, and stores the predetermined time ST into the RAM 233. The controller 230 then receives a signal from the temperature sensor 89 to correct the predetermined time ST stored in the RAM 233 based on the temperature t indicated by the received signal and temperature correction information stored in the ROM 232. More specifically, the controller 230 calculates a correction amount Δ based on the temperature correction information ($\Delta = p \times t + q$, where p and q are constants), adds the correction amount A to the predetermined time ST to calculate a corrected predetermined time ST, and stores the corrected predetermined time ST into the RAM 233.

The controller 230 then determines the current elapsed time T after receiving a low-level signal, a high-level signal, and then a low-level signal in the stated order from the installation sensor 154 (S54: Yes). For example, the controller 230 stores, into the RAM 233, the time at which a low-level signal is received after a high-level signal is received from the installation sensor 154, and determines the elapsed time T based on the stored time and the current time. The elapsed time T may be determined based on the time indicated by a timer activated upon receiving a low-level signal after receiving a high-level signal from the installation sensor 154.

The controller 230 determines whether the determined elapsed time T exceeds the predetermined time ST (S58). When the controller 230 determines that the elapsed time T does not exceed the predetermined time ST (S58: No), the controller 230 repeats the determination in steps S57 and S58 until a low-level signal is received or the elapsed time T exceeds the predetermined time ST. More specifically, the controller 230 waits until the liquid level of the ink in the second reservoir 105 increases to the predetermined level B or the predetermined time ST elapses after the ink cartridge 50 is installed.

When determining that the elapsed time T exceeds the predetermined time ST (S58: Yes), the controller 230 deletes the ink in-flow screen from the display 17, and displays a notification screen S_Empty on the display 17 (S59). The notification screen S_Empty displayed in step S59 may be the same as or different from the screen displayed in step S52. The controller 230 then performs the processing in step S51 and subsequent steps again. The notification screen S_Empty appearing on the display 17 in step S59 is an example of activating a fourth notification of the alarm.

When determining that the signal received from the liquid level sensor 155 has changed from a high-level signal to a low-level signal (S57: Yes), the controller 230 calculates the total amount Vt after the cartridge replacement (S60). In detail, the controller 230 calculates the ink amount Vs before the cartridge replacement based on the count value SN before the cartridge replacement stored in the EEPROM 234 and the ink amount Vsc stored in the ROM 232 ($Vs = Vsc - SN$), and stores the ink amount Vs into the EEPROM 234. The ink amount Vs before the cartridge replacement is equal to the total amount Vt before the cartridge replacement. Based on the calculated ink amount Vs and the ink amount Vc read from the memory of the IC chip 66 of the replaced ink cartridge 50, the total amount Vt after the cartridge replacement is calculated ($Vt = Vs + Vc$). Once the ink cartridge 50 is replaced, a portion of the ink amount Vc stored in the first reservoir 53 of the newly-installed ink cartridge 50 is added to the ink amount Vs ($= Vsc - SN$) stored in the second reservoir 105 of the subtank 100 immediately before the ink cartridge 50 is replaced.

The controller 230 calculates the ink amount Vc and the ink amount Vs obtained when ink transfer from the first reservoir 53 to the second reservoir 105 is complete based on the calculated total amount Vt and the volume $V_{th}$ read from the EEPROM 234 (S60). When the ink cartridge 50 is replaced, the ink stored in the first reservoir 53 of the newly installed ink cartridge 50 flows into the second reservoir 105 of the subtank 100 through the liquid flow path 103. As a result, the ink amount Vc of the first reservoir 53 decreases, and the ink amount Vs of the second reservoir 105 increases. The liquid level of the ink in the second reservoir 105 of the subtank 100 then reaches the imaginary line L, and the equilibrium state is entered.

The controller 230 determines whether the calculated total amount Vt is equal to or greater than the volume $V_{th}$. For example, when a fresh ink cartridge 50 is installed in the installation case 71, the total amount Vt is equal to or greater than the volume $V_{th}$. For the total amount Vt equal to or greater than the volume $V_{th}$, the controller 230 determines the volume $V_{th}$ to be the ink amount Vs. The controller 230 then stores the calculated ink amount Vc into the EEPROM 234 (S61). At this time, the controller 230 updates the ink amount Vs stored in the EEPROM 234 to the calculated ink amount Vs. The controller 230 also stores the calculated ink amount Vc into the memory of the IC chip 66 through the contact 152 (S61). At this time, the controller 230 updates the ink amount Vc stored in the memory of the IC chip 66 to the calculated ink amount Vc.

The controller 230 then sets each of the flag S Empty and the flag C_Empty OFF. The controller 230 also deletes the notification screen S_Empty and the notification screen C_Empty appearing on the display 17 (S62). Further, the controller 230 displays the calculated ink amounts Vc and Vs on the display 17. The controller 230 may display the calculated total amount Vt on the display 17. The total amount Vt and the ink amounts Vc and Vs may be numerically indicated, or may be indicated using an image, such as an index bar. Not both the ink amount Vc and the ink amount Vs may be indicated, and at least one of the ink amounts, or for example, the ink amount Vc alone, may be indicated. The controller 230 then performs the processing in step S51 and subsequent steps again.

When the flags S_Empty corresponding to all the ink cartridges 50 are all not ON, or in other words, are all OFF (S51: OFF), the controller 230 receives signals output from the four liquid level sensors 155 at the current time (S63). In step S63, the controller 230 further causes the RAM 233 to store information indicating whether the signal received from each liquid level sensor 155 is a high-level signal or a low-level signal.

The controller 230 then records the image represented by the image data included in the recording instruction on one sheet (S64). More specifically, the controller 230 causes the sheet on the feed tray 20 to be conveyed by the feed roller 25 and the conveyance roller 34, the printhead 39 to discharge the ink, and the sheet having the recorded image to be discharged to the discharge tray 21 with the discharge roller 36. More specifically, the controller 230 performs the processing in step S64 when all the four flags S_Empty are set OFF (S51: OFF). More specifically, the controller 230 enables the ink discharge through the printhead 39. In contrast, the controller 230 does not perform the processing in step S64 when at least one of the four flags S_Empty is set ON (S51: ON). More specifically, the controller 230 disables the ink discharge through the printhead 39 for all the four subtanks 100.

The controller 230 then receives signals output from the four liquid level sensors 155 at the current time upon recording the image on one sheet in response to the recording instruction (S65). Similarly to step S63, the controller 230 causes the RAM 233 to store information indicating whether the signal received from the liquid level sensor 155 is a high-level signal or a low-level signal (S65). The controller 230 then performs a counting process (S66). The counting process is to update the count values TN, SN, the flag C_Empty, and the flag S_Empty based on the signals received from each liquid level sensor 155 in steps S63 and S65. The counting process will be described in detail below with reference to FIG. 19.

The controller 230 then repeatedly performs the processing in steps S51 to S67 until all the images indicated by the recording instruction are recorded on one sheet until no next sheet is provided (S67: Yes). When all the images indicated by the recording instruction are recorded on one sheet and no next sheet is provided (S67: No), the controller 230 determines the set values for the four flags S_Empty and the set values for the four flags C_Empty (S68 and S69).

When at least one of the four flags S_Empty is set ON (S68: ON), the controller 230 displays the notification screen S_Empty on the display 17 (S70). When all the four flags S_Empty are set OFF and at least one of the four flags C_Empty is set ON (S68: OFF and S69: ON), the controller 230 displays the notification screen C_Empty on the display 17 (S71). The processing in steps S68 and S69 is an example of activating a first notification of the alarm.

The notification screen S_Empty displayed in step S70 may be the same as in step S52. The notification screen C_Empty notifies the user that the ink cartridge 50 corresponding to the flag C_Empty set ON is in the cartridge empty state. For example, the notification screen C_Empty may include information indicating the color and the ink amounts Vc and Vs of the ink stored in the ink cartridge 50 in the cartridge empty state.

Figure 20C:
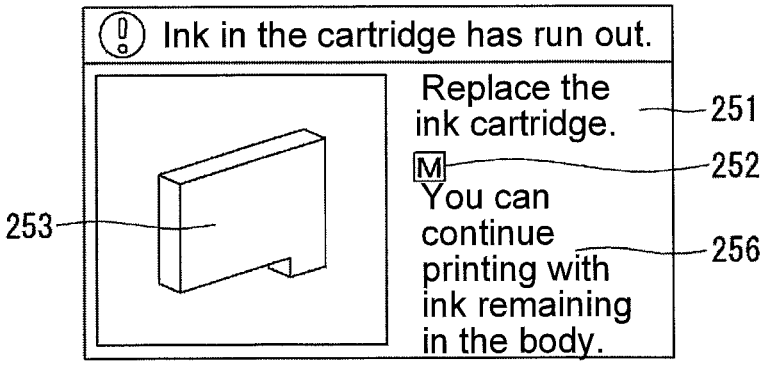
FIG. 20C is a diagram showing a notification screen C_Empty.

FIG. 20C is a diagram showing an example notification screen C_Empty. In the illustrated example, the notification screen C_Empty includes objects 251, 252, and 253, in the same manner as the notification screen S_Empty in FIG. 20A, and further includes an object 256. The object 256 carries a text message: You can continue printing with ink remaining in the body. This notifies the user that printing can be continued.

In contrast, when all the four flags S_Empty and the four flags C_Empty are set OFF (S69: OFF), the controller 230 completes the image recording process.

An example of the discharge instruction is not limited to the recording instruction, but may be a maintenance instruction instructing maintenance of the nozzles 40 such as a purge. For example, the controller 230 performs the same process as in FIGS. 18A and 18B in response to a maintenance instruction received through the operation panel 22. The process in response to a maintenance instruction differs from the above process in the manner described below. First, the controller 230 drives a maintenance mechanism (not shown) in step S64, and discharges the ink through the nozzles 40. The controller 230 also performs the processing in steps subsequent to step S67 without performing the processing in step S67 after the counting process.

Counting Process

Figure 19:
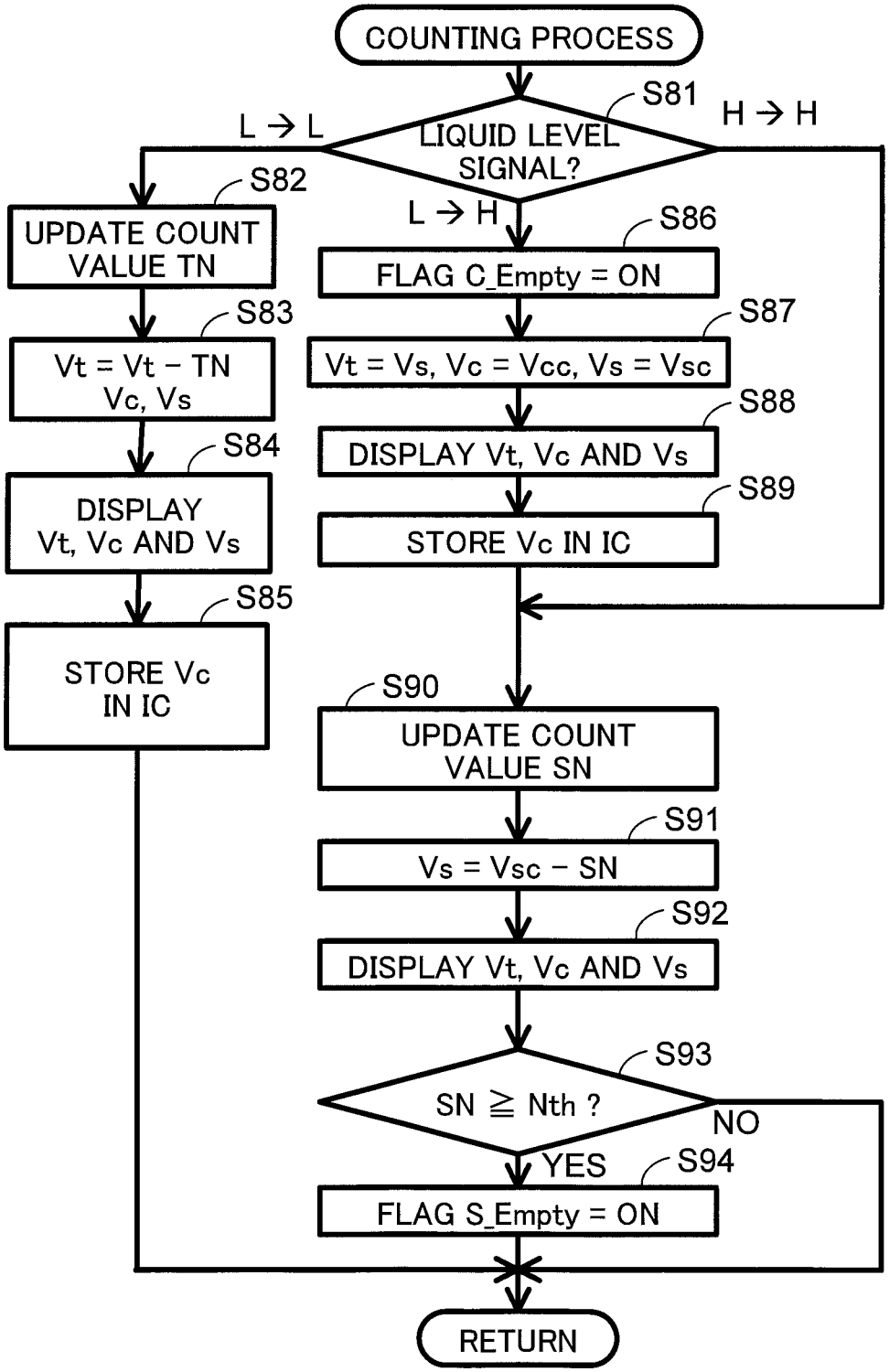
FIG. 19 is a flowchart of a counting process according to the second embodiment.

The counting process performed by the controller 230 in step S66 will be described in detail with reference to FIG. 19. The controller 230 performs the counting process independently for each of the four ink cartridges 50. The counting process is common to the ink cartridges 50. The counting process for one ink cartridge 50 will be described.

First, the controller 230 compares sets of information indicating the signals from the liquid level sensors 155 stored in the RAM 233 in steps S63 and S65 (S81). More specifically, the controller 230 determines whether the signal output from each of the four liquid level sensors 155 has changed before and after the processing in step S64 immediately before the counting process (S66).

When the sets of information stored in the RAM 233 in steps S63 and S65 both indicate a low-level signal (S81: L→L) (in other words, the signal output from each liquid level sensor 155 remains unchanged before and after the processing in step S64), the controller 230 updates the count value TN (S82). More specifically, the controller 230 counts up the count value TN to a value equivalent to the amount of ink instructed to discharge in the immediately preceding step S64.

The controller 230 also calculates the current total amount Vt (S83). First, the controller 230 calculates the total amount Vt after the cartridge replacement that is the sum of the ink amount Vc and the ink amount Vs stored in the EEPROM 234 after the cartridge is replaced. The controller 230 then calculates the current total amount Vt by subtracting the ink amount equivalent to the count value TN from the calculated total amount Vt (Vt=Vt−TN). The controller 230 then obtains the ink amounts Vc and Vs based on the calculated current total amount Vt and the volume $V_{th}$ (S83).

The controller 230 determines whether the calculated current total amount Vt is equal to or greater than the volume $V_{th}$. For the current total amount Vt equal to or greater than the volume $V_{th}$, the controller 230 determines the volume $V_{th}$ to be the ink amount Vs. For the current total amount Vt smaller than the volume $V_{th}$, the controller 230 determines the current total amount Vt to be the ink amount Vs.

Subsequently, the controller 230 displays the calculated ink amounts Vc and Vs and/or the calculated total amount Vt on the display 17 (S84). The controller 230 also updates the ink amount Vc stored in the memory of the IC chip 66 of the ink cartridge 50 to the calculated ink amount Vc (S85).

When the information stored in the RAM 233 in step S63 indicates a low-level signal and the information stored in the RAM 233 in step S65 indicates a high-level signal (S81: L→) (in other words, the signal output from each liquid level sensor 155 is changed before and after the processing in step S64), the controller 230 sets the flag C_Empty ON (S86). The output from the liquid level sensors 155 changing from a low-level signal to a high-level signal corresponds to the liquid level of the second reservoir 105 reaching the predetermined level B during the processing in step S64. Subsequently, no ink transfer occurs between the ink cartridge 50 and the subtank 100.

The controller 230 also reads a predetermined ink amount Vcc (=0) from the ROM 232, and sets the ink amount Vc to the predetermined ink amount Vcc (S87). Similarly, the controller 230 reads a predetermined ink amount Vsc (equivalent to the volume of a part of the second reservoir 105 lower than the predetermined level B) from the ROM 232, and sets the ink amount Vs to the predetermined ink amount Vsc (S87). The ink amounts Vc and Vs calculated in the counting process include errors. The controller 230 thus sets the ink amount Vc to the predetermined ink amount Vcc and sets the ink amount Vs to the predetermined ink amount Vsc at the time when the output from the liquid level sensor 155 changes from a low-level signal to a high-level signal, thus resetting the accumulated errors. Further, the controller 230 calculates the current total amount Vt as a value equal to the ink amount Vs (Vt=Vsc) (S87). When the ink amount Vc is zero, the total amount Vt has the same value as the ink amount Vs.

The controller 230 then displays the current ink amounts Vc and Vs and/or the current total amount Vt on the display 17. The controller 230 also overwrites the ink amount Vc stored in the memory of the IC chip 66 of the ink cartridge 50 with the above ink amount Vc (=0) (S89).

The signal output from each liquid level sensor 155 changes during the processing in step S64, and thus the predetermined ink amount Vsc read in step S87 is not strictly the amount of ink stored in the subtank 100 at the moment when the signal output from the liquid level sensor 155 changes, but indicates the amount of ink immediately before the signal output from the liquid level sensor 155 changes. With the difference between the ink amounts being small, the predetermined ink amount Vsc read in step S87 is approximately the ink amount Vs at the time when the signal output from the liquid level sensor 155 changes.

The controller 230 also updates the count value SN stored in EEPROM 234 to the value equivalent to the amount of ink instructed to discharge in the immediately preceding step S64 (S90). In other words, the controller 230 starts updating and counting up the count value SN in response to the output from the liquid level sensors 155 changing from a low-level signal to a high-level signal. The controller 230 counts up the count value TN stored in the EEPROM 234 to a value equivalent to the amount of ink instructed to discharge in the immediately preceding step S64.

The controller 230 then calculates the ink amount Vs (S91). The calculated ink amount Vs is obtained by subtracting the ink amount equivalent to the count value SN stored in the EEPROM 234 from the predetermined ink amount Vsc stored in the ROM 232. As described above, after the output from the liquid level sensor 155 changes to a high-level signal, the ink amount Vs is the same value as the current total amount Vt. The ink amount Vc is zero.

The controller 230 then displays the calculated current ink amounts Vc and Vs and/or the calculated current total amount Vt on the display 17 (S92). The ink amount Vc is zero after the output of liquid level sensor 155 changes to a high-level signal, and thus the controller 230 does not update the ink amount Vc stored in the memory of the IC chip 66 of the ink cartridge 50.

The controller 230 then compares the count value SN updated in step S90 with the threshold value Nth (S93). When determining that the count value SN updated in step S90 is smaller than the threshold value $N_{th}$ (S93: No), the controller 230 completes the counting process. In contrast, when determining that the count value SN updated in step S90 is equal to or greater than the threshold value Nth (S93: Yes), the controller 230 sets the flag S_Empty ON (S94). The controller 230 disables the ink discharge through the printhead 39 in response to the flag S_Empty set ON, and completes the counting process.

When the sets of information stored in the RAM 233 in steps S63 and S65 both indicate a high-level signal (S91: H→H), the controller 230 reads the count value SN stored in the EEPROM 234. The controller 230 then counts up the read count value SN to a value equivalent to the amount of ink instructed to discharge in the immediately preceding step S64 and stores the value into the EEPROM 234 again. More specifically, the controller 230 updates the count value SN (S90). The controller 230 also updates the count value TN. The controller 230 then performs the processing from steps S91 to S94 described above using the count value SN updated in step S90.

Operational Effects of Second Embodiment

The structure according to the second embodiment can delete the notification screen S_Empty from the display 17 in response to a low-level signal received from the liquid level sensor 155 after a low-level signal is received from installation sensor 154 and before the predetermined time ST elapses.

Further, the ink in-flow screen can appear on the display 17 in response to a low-level signal received from the installation sensor 154, and the notification screen S_Empty can appear again on the display 17 when the elapsed time T exceeds the predetermined time ST. Additionally, the controller 230 uses, in determining whether the elapsed time T exceeds the predetermined time ST, a different predetermined time ST in accordance with the type information about the installed ink cartridge 50 or a signal from the temperature sensor 89, thus allowing appropriate determination that ink is not flowing from the ink cartridge 50 into the subtank 100.

Modification of Second Embodiment

In the second embodiment, the ink in-flow screen appears on the display 17 in response to a low-level signal received from the installation sensor 154. The ink in-flow screen may not appear, and the notification screen S_Empty may remain appearing. Instead of displaying the ink in-flow screen, the notification screen S_Empty may be deleted. When the notification screen S_Empty continues to appear or is deleted without displaying the ink in-flow screen, the controller 230 may display the notification screen S_Empty on the display 17 when the elapsed time T from the installation of the ink cartridge 50 exceeds the predetermined time ST (S58: Yes). The notification screen S_Empty appearing on the display 17 in this case is an example of activating a second notification of the alarm.

In the second embodiment, when all the four flags S_Empty are set OFF, the controller 230 enables ink discharge through the printhead 39. Thus, when the notification screen C_Empty appears with all the four flags S_Empty set OFF and the user replaces the ink cartridge 50, ink discharge is enabled through the printhead 39. When the ink cartridge 50 is replaced, or more specifically, in response to a low-level signal, a high-level signal, and then a low-level signal received in the stated order from the installation sensor 154, the controller 230 may disable ink discharge through the printhead 39. When ink flows from the ink cartridge 50 into the subtank 100 and in response to a low-level signal received from the liquid level sensor 155, the controller 230 may enable ink discharge through the printhead 39.

In the second embodiment, the controller 230 corrects the predetermined time ST based on the temperature t detected by the temperature sensor 89 (S58). As the temperature increases, the viscosity of the ink decreases to increase the inflow rate of the ink from the ink cartridge 50 into the subtank 100. As the inflow rate increases, less time is taken for the same volume of ink to flow in. Thus, the predetermined time ST may be corrected to shorten as the temperature t increases.

The predetermined time ST may also be corrected based on the viscosity of the ink. As the viscosity of the ink increases, the inflow rate of the ink from the ink cartridge 50 into the subtank 100 decreases. Thus, the predetermined time ST may be corrected to extend as the viscosity of the ink increases. For example, the controller 230 may correct the predetermined time ST stored in the RAM 233 based on the information indicating the viscosity of the ink stored in the memory of the IC chip 66 of the ink cartridge 50 (S58).

The predetermined time ST may also be corrected based on the liquid level of the ink stored in the first reservoir 53 of the ink cartridge 50. As the liquid level increases, the inflow rate of the ink from the ink cartridge 50 into the subtank 100 increases. Thus, the predetermined time ST may be corrected to shorten as the liquid level increases. For example, the controller 230 may correct the predetermined time ST stored in the RAM 233 based on the information stored in the memory of the IC chip 66 of the ink cartridge 50 and indicating the liquid level of the ink stored in the first reservoir 53 (S58).

Other Modifications

In one or more of the above embodiments, the controller 230 performs the processing in step S15 in response to a low-level signal, a high-level signal, and then a low-level signal received in the stated order from the installation sensor 154 (S14:Yes). The controller 230 performs the processing in step S15 in response to the ink cartridge 50 installed in the installation case 71 previously containing no ink cartridge 50. More specifically, the controller 230 may perform the processing in step S15 when determining that the ink cartridge 50 is installed in the installation case 71. The controller 230 receiving a low-level signal, a high-level signal, and then a low-level signal in the stated order from the installation sensor 154 is an example of the controller 230 determining that the cartridge is installed in the installation case 71. Other examples of the controller 230 determining that the ink cartridge 50 is installed in the installation case 71 will be described below.

For example, the controller 230 receives a low-level signal after receiving a high-level signal from the cover sensor 88. The controller 230 then reads identification information from the memory of the IC chip 66 and compares the read identification information with identification information for the ink cartridge 50 yet to be replaced stored in the EEPROM 234. When determining that the identification information read from the memory of the IC chip 66 disagrees with the identification information stored in the EEPROM 234, the controller 230 may perform the processing in step S35. More specifically, an example of the controller 230 determining that the ink cartridge 50 is installed in the installation case 71 includes the controller 230 reading identification information from the memory of the IC chip 66, comparing the read identification information with identification information for the ink cartridge 50 yet to be replaced stored in the EEPROM 234, and determining, as a result, that the identification information read from the memory of the IC chip 66 disagrees with the identification information stored in the EEPROM 234.

For example, the controller 230 receives a low-level signal after receiving a high-level signal from the cover sensor 88. The controller 230 then displays, to the user, a confirmation screen on the display 17 indicating whether an ink cartridge 50 is newly installed in the installation case 71. The controller 230 receives an input corresponding to the confirmation screen through the operation panel 22 while the confirmation screen is on the display 17. The controller 230 performs the processing in step S35 when the received input corresponds to an ink cartridge 50 newly installed in the installation case 71. More specifically, an example of the controller 230 determining that the ink cartridge 50 is installed in the installation case 71 includes the controller 230 receiving a low-level signal after receiving a high-level signal from the cover sensor 88, displaying, to the user, a confirmation screen on the display 17 indicating whether an ink cartridge 50 is newly installed in the installation case 71, and receiving an input corresponding to the confirmation screen through the operation panel 22 while the confirmation screen is on the display 17, with the received input then corresponding to an ink cartridge 50 newly installed in the installation case 71.

In the above embodiments, the liquid level sensor 155 optically detects the liquid level of the ink in the second reservoir 105 using a prism with different reflectance values depending on whether the ink is in contact with the rear wall 112 of the second reservoir 105. However, the liquid level sensor 155 may have any structure to detect the liquid level of the ink in the second reservoir 105. For example, the second reservoir 105 may contain an actuator that rotates depending on whether the liquid level in the second reservoir 105 is lower than a boundary position B, and the liquid level sensor 155 may detect a detection target portion included in the actuator located at a detection position. In some embodiments, the liquid level of the ink in the second reservoir 105 may be detected with an electrode. The liquid level sensor 155 may also output different signals for different liquid levels in the first reservoir 53 of the ink cartridge 50, instead of outputting different signals for different liquid levels in the second reservoir 105 of the subtank 100.

In the above embodiments, when at least one of the four flags S_Empty is set ON, all the four subtanks 100 are disabled from discharging ink through the printhead 39. The subtank 100 for which the flag S_Empty is set ON may be selectively disabled from discharging ink through the printhead 39. When at least one of the flags S_Empty associated with magenta, cyan, and yellow is set ON, and the flag S Empty associated with black is set OFF, the discharge of the magenta, cyan, and yellow inks may be disabled, and the discharge of the black ink may be enabled.

The IC chip 66 is electrically connectable to the contact 152 through contact. However, an information medium and an interface such as near field communication (NFC) or radio frequency identification (RFID) may be used for reading and writing data in a contactless manner using radio waves.

In the embodiments described above, the ink is an example of liquid. However, the liquid may be a pretreatment liquid discharged to a sheet or another substrate before ink is applied in image recording, or may be water for cleaning the printhead 39.

What is claimed is:

1. A liquid discharge device, comprising:

a tank;

an installation case in which a cartridge is to be installed;

a head communicating with the tank;

a liquid level sensor;

a memory; and a controller, wherein the cartridge includes a first liquid chamber storing liquid, wherein the tank includes:

a second liquid chamber to store the liquid;

a liquid flow path and a gas flow path communicating with the second liquid chamber; and an air communication path allowing the second liquid chamber to communicate with outside, wherein the liquid flow path has a first end having a first opening communicating with the second liquid chamber, and a second end opposite to the first end and having a second opening that is open to outside, wherein the gas flow path has a first end having a third opening communicating with the second liquid chamber, and a second end opposite to the first end and having a fourth opening that is open to outside, in an installed state of the cartridge installed in the installation case and having the first liquid chamber in the cartridge communicating with the second opening of the liquid flow path and the fourth opening of the gas flow path in the tank:

the first liquid chamber includes a portion located higher than the second opening; and the second liquid chamber includes a portion located lower than the third opening, wherein the controller is configured to:

receive a first discharge instruction to discharge liquid through the head;

update a first count value to a value equivalent to an amount of liquid instructed to discharge in accordance with the received first discharge instruction;

subtract the first count value from a total liquid amount Vt of a liquid amount Vc of the liquid stored in the first liquid chamber and a liquid amount Vs of the liquid stored in the second liquid chamber to calculate a value of the total liquid amount Vt;

determine the liquid amount Vc and the liquid amount Vs based on the calculated value of the total liquid amount Vt;

receive, from the liquid level sensor, a first signal output from the liquid level sensor when the second liquid chamber has a liquid level equal to or higher than a predetermined level;

determine the total liquid amount Vt or the liquid amount Vs to be a fixed value A when receiving, after receiving the first signal, a second signal output from the liquid level sensor in response to the second liquid chamber having a liquid level lower than the predetermined level;

receive, after receiving the first signal and then the second signal from the liquid level sensor, a second discharge instruction to discharge liquid through the head;

update, in response to the second discharge instruction, a second count value to a value equivalent to an amount of liquid instructed to discharge in accordance with the second discharge instruction; and subtract the second count value from the fixed value A determined as the total liquid amount Vt or the liquid amount Vs to calculate a value of the total liquid amount Vt or a value of the liquid amount Vs.

2. The liquid discharge device according to claim 1, wherein the controller is further configured to update the liquid amount Vc stored in the memory to zero in response to the second signal received from the liquid level sensor after the first signal is received.

3. The liquid discharge device according to claim 2, wherein in the installed state of the cartridge installed in the installation case, the predetermined level is equal to or lower than an imaginary line extending in a horizontal direction through the third opening of the gas flow path.

4. The liquid discharge device according to claim 1, further comprising:

an alarm, wherein the controller is further configured to activate the alarm within a period from when the liquid amount Vc reaches zero to when the total liquid amount Vt or the liquid amount Vs reaches zero.

5. The liquid discharge device according to claim 1, further comprising:

an interface, wherein the controller is further configured to store the determined liquid amount Vc into a cartridge memory included in the cartridge through the interface.

6. The liquid discharge device according to claim 5, wherein the controller is further configured to:

determine whether the cartridge is installed in the installation case;

read the liquid amount Vc stored in the cartridge memory when determining that the cartridge is installed in the installation case; and calculate a value of the total liquid amount Vt based on the liquid amount Vc read from the cartridge memory and the total liquid amount Vt or the liquid amount Vs stored in the memory before the cartridge is determined to be installed, and store the calculated value of the total liquid amount Vt into the memory.

7. The liquid discharge device according to claim 5, wherein the controller is further configured to store ink runout information into the cartridge memory through the interface when the liquid amount Vc reaches zero.

8. The liquid discharge device according to claim 1, wherein the memory stores an arithmetic expression, and the controller is further configured to calculate at least one of the liquid amount Vc or the liquid amount Vs based on the total liquid amount Vt and the arithmetic expression.

9. A liquid discharge device, comprising:

a tank;

an installation case in which a cartridge is to be installed;

a head communicating with the tank;

a liquid level sensor;

an alarm; and a controller, wherein the cartridge includes a first liquid chamber storing liquid, wherein the tank includes:

a second liquid chamber to store the liquid;

a liquid flow path and a gas flow path communicating with the second liquid chamber; and an air communication path allowing the second liquid chamber to communicate with outside, wherein the liquid flow path has a first end having a first opening communicating with the second liquid chamber, and a second end opposite to the first end and having a second opening that is open to outside, wherein the gas flow path has a first end having a third opening communicating with the second liquid chamber, and a second end opposite to the first end and having a fourth opening that is open to outside, in an installed state of the cartridge installed in the installation case and having the first liquid chamber in the cartridge communicating with the second opening of the liquid flow path and the fourth opening of the gas flow path in the tank:

the first liquid chamber includes a portion located higher than the second opening; and the second liquid chamber includes a portion located lower than the third opening, wherein the controller is configured to:

receive, from the liquid level sensor, a first signal output from the liquid level sensor when the second liquid chamber has a liquid level lower than a predetermined level;

activate a first notification of the alarm in response to the received first signal;

determine whether the cartridge is installed in the installation case;

receive a second signal output from the liquid level sensor when the second liquid chamber has a liquid level equal to or higher than the predetermined level; and deactivate the first notification in response to the second signal received from the liquid level sensor after the cartridge is determined to be installed in the installation case.

10. The liquid discharge device according to claim 9, wherein the controller is further configured to:

receive a discharge instruction to discharge liquid through the head;

update a count value to a value equivalent to an amount of liquid instructed to discharge in accordance with the discharge instruction received after receiving the first signal;

determine whether the count value has reached a threshold; and activate the first notification of the alarm when determining that the count value has reached the threshold.

11. The liquid discharge device according to claim 9, wherein the controller is further configured to:

disable discharging of the liquid through the head in response to the received first signal; and enable disabled discharging of the liquid through the head in response to the second signal received from the liquid level sensor after the cartridge is determined to be installed in the installation case.

12. The liquid discharge device according to claim 9, wherein the controller is further configured to activate a second notification of the alarm when receiving no second signal from the liquid level sensor before determining that an elapsed time from when the cartridge is determined to be installed in the installation case exceeds a predetermined time.

13. The liquid discharge device according to claim 9, wherein the controller is further configured to:

activate a third notification of the alarm in response to the cartridge determined to be installed in the installation case; and activate a fourth notification of the alarm when receiving no second signal from the liquid level sensor before determining that an elapsed time from when the cartridge is determined to be installed in the installation case exceeds a predetermined time.

14. The liquid discharge device according to claim 12, further comprising:

an interface, wherein the controller is further configured to:

read, in response to the cartridge determined to be installed in the installation case, cartridge information stored in a cartridge memory included in the cartridge through the interface; and use, in determining whether the elapsed time exceeds the predetermined time, a different predetermined time in accordance with the cartridge information indicating a different type of the cartridge, indicating a different viscosity of the liquid stored in the first liquid chamber, or indicating a different liquid level of the first liquid chamber.

15. The liquid discharge device according to claim 12, further comprising:

a temperature sensor, wherein the controller is further configured to:

receive a signal output from the temperature sensor based on an ambient temperature; and use, in determining whether the elapsed time exceeds the predetermined time, a different predetermined time in accordance with a different signal received from the temperature sensor.

16. A liquid discharge device, comprising:

a tank;

an installation case in which a cartridge is to be installed;

a head communicating with the tank;

a liquid level sensor; and a controller, wherein the cartridge includes a first liquid chamber storing liquid, wherein the tank includes:

a second liquid chamber to store the liquid;

a liquid flow path and a gas flow path communicating with the second liquid chamber; and an air communication path allowing the second liquid chamber to communicate with outside, wherein the liquid flow path has a first end having a first opening communicating with the second liquid chamber, and a second end opposite to the first end and having a second opening that is open to outside, wherein the gas flow path has a first end having a third opening communicating with the second liquid chamber, and a second end opposite to the first end and having a fourth opening that is open to outside, in an installed state of the cartridge installed in the installation case and having the first liquid chamber in the cartridge communicating with the second opening of the liquid flow path and the fourth opening of the gas flow path in the tank;

the first liquid chamber includes a portion located higher than the second opening; and the second liquid chamber includes a portion located lower than the third opening, wherein the controller is configured to:

receive, from the liquid level sensor, a first signal output from the liquid level sensor when the second liquid chamber has a liquid level lower than a predetermined level;

disable discharging of the liquid through the head in response to the received first signal;

determine whether the cartridge is installed in the installation case;

receive a second signal output from the liquid level sensor when the second liquid chamber has a liquid level equal to or higher than the predetermined level; and enable discharging of the liquid through the head in response to the second signal received from the liquid level sensor after the cartridge is determined to be installed in the installation case.

17. The liquid discharge device according to claim 16, further comprising:

an alarm, wherein the controller is further configured to:

activate a first notification of the alarm in response to the received first signal; and deactivate the first notification in response to the second signal received from the liquid level sensor after the cartridge is determined to be installed in the installation case.

18. The liquid discharge device according to claim 16, wherein the controller is further disable discharging of the liquid through the head in response to the cartridge determined to be installed in the installation case.

19. A liquid discharge device, comprising:

a cartridge;

a tank;

an installation case in which a cartridge is to be installed;

a head communicating with the tank;

a liquid level sensor;

an alarm; and a controller, wherein the cartridge includes a first liquid chamber storing liquid, wherein the tank includes;

a second liquid chamber to store the liquid;

a liquid flow path and a gas flow path communicating with the second liquid chamber; and an air communication path allowing th second liquid chamber to communicate with outside;

wherein the liquid flow path has a first end having a first opening communicating with the second liquid chamber, and a second end opposite to the first end and having a second opening that is open to outside, wherein the gas flow path has a first end having a third opening communicating with the second liquid chamber, and a second end opposite to the first end and having a fourth opening that is open to outside, in an installed state of the cartridge installed in the installation case and having the first liquid chamber in the cartridge communicating with the second opening of the liquid flow path and the fourth opening of the gas flow path in the tank:

the first liquid chamber includes a portion located higher than the second opening; and the second liquid chamber includes a portion located lower than the third opening, the controller is further configured to:

receive, from the liquid level sensor, a first signal output from the liquid level sensor when the second liquid chamber has a liquid level lower than a predetermined level;

activate a first notification of the alarm in response to the received first signal, determines whether the cartridge is installed in the installation case;

receive a second signal output from the liquid level sensor when the second liquid chamber has a liquid level equal to or higher than the predetermined level; and deactivate the first notification in response to the second signal received from the liquid level sensor after the cartridge is determined to be installed in the installation case.

20. A liquid discharge device, comprising:

a cartridge;

a tank;

an installation case in which a cartridge is to be installed;

a head communicating with the tank;

a liquid level sensor; and a controller, wherein the cartridge includes a first liquid chamber storing liquid, wherein the tank includes:

a second liquid chamber configured to store the liquid;

a liquid flow path and a gas flow path communicating with the second liquid chamber; and an air communication path allowing the second liquid chamber to communicate with outside, wherein the liquid flow path has a first end having a first opening communicating with the second liquid chamber, and a second end opposite to the first end and having a second opening that is open to outside, wherein the gas flow path has a first end having a third opening communicating with the second liquid chamber, and a second end opposite to the first end and having a fourth opening that is open to outside, in an installed state of the cartridge installed in the installation case and having the first liquid chamber in the cartridge communicating with the second opening of the liquid flow path and the fourth opening of the gas flow path in the tank:

the first liquid chamber includes a portion located higher than the second opening; and the second liquid chamber includes a portion located lower than the third opening, wherein the controller is configured to:

receive, from the liquid level sensor, a first signal output from the liquid level sensor when the second liquid chamber has a liquid level lower than a predetermined level;

disable discharging of the liquid through the head in response to the received first signal;

determine whether the cartridge is installed in the installation case;

receive a second signal output from the liquid level sensor when the second liquid chamber has a liquid level equal to or higher than the predetermined level; and enable discharging of the liquid through the head in response to the second signal received from the liquid level sensor after the cartridge is determined to be installed in the installation case.

* * * * *